US005307657A

United States Patent [19]

Klein et al.

[11] Patent Number: 5,307,657

[45] Date of Patent: May 3, 1994

[54] PERMUTATION LOCK, IN PARTICULAR FOR TRUNKS PIECES OF FURNITURE OR THE LIKE

[75] Inventors: Helmut Klein, Heidekamp; Jürgen Sersch, Hasencleverstrasse, both of Fed. Rep. of Germany

[73] Assignee: S. Franzen Söhne (GmbH & Co.), Solingen, Fed. Rep. of Germany

[21] Appl. No.: 880,178

[22] Filed: May 6, 1992

[30] Foreign Application Priority Data

May 25, 1991 [DE] Fed. Rep. of Germany ... 9106464[U]
Apr. 10, 1992 [DE] Fed. Rep. of Germany ... 9204996[U]

[51] Int. Cl.[5] ..... E05B 37/02

[52] U.S. Cl. ..... 70/312; 70/314; 70/322

[58] Field of Search ..... 70/312, 314, 321, 322

[56] References Cited

U.S. PATENT DOCUMENTS

| | | | |
|---|---|---|---|
| 1,606,279 | 11/1926 | Wildrick | 70/312 |
| 1,845,021 | 2/1932 | Hope | 70/314 |
| 2,885,881 | 5/1959 | Syler . | |
| 3,633,388 | 1/1972 | Atkinson | 70/314 X |
| 4,366,684 | 1/1983 | Bako et al. | 70/312 X |
| 4,366,687 | 1/1983 | Atkinson | 70/312 X |
| 4,520,641 | 6/1985 | Bako | 70/312 |
| 4,770,013 | 9/1988 | Nakai | 70/285 |
| 4,905,488 | 3/1990 | Hatsuo | 70/312 |
| 5,007,262 | 4/1991 | Nakai | 70/312 |

FOREIGN PATENT DOCUMENTS

| | | | |
|---|---|---|---|
| 3246272 | 6/1983 | Fed. Rep. of Germany . | |
| 207684 | 12/1923 | United Kingdom | 70/314 |

*Primary Examiner*—Lloyd A. Gall
*Attorney, Agent, or Firm*—Martin A. Farber

[57] ABSTRACT

A permutation lock, in particular for suitcases or the like, having a plurality of number disks (12) which can be turned by rotation into the combination opening position and an operating handle upon the opening displacement of which the combination set is changed. In order to obtain a simple solution which is advantageous in use, each number disk (12) has associated with it a cam (45) which turns the number disk into a given basic position other than the combination upon displacement of the operating handle (35).

30 Claims, 36 Drawing Sheets

4
12
36
XX
37
1
35
3'
3
XX
2

PERMUTATION LOCK, IN PARTICULAR FOR TRUNKS PIECES OF FURNITURE OR THE LIKE

FIELD AND BACKGROUND OF THE INVENTION

The present invention relates to a permutation lock.

A permutation lock is known from U.S. Pat. No. 3,633,388, in which, after setting the pre-established combination, a door equipped with the permutation lock can be opened. During the displacement for the opening, a slide is carried along, protruding spring projections of which come against the periphery of the number disks which have been previously released for rotation, the slide turning them thereby changing the combination set. A change in the combination is also effected upon an oppositely directed displacement of the slide. This embodiment has the disadvantage that the number disks are as a rule always turned by the same amount. When this principle is employed, it is entirely possible to discover a given part of the combination by turning the number disks back.

SUMMARY OF THE INVENTION

The object of the invention is to provide a permutation lock of this type which is of simple construction and increased security value.

As a result of the invention, a permutation lock of this type is provided which is characterized, in particular, by increased security. When a permutation lock present on a trunk, piece of furniture or the like assumes its closed position, the opening thereof requires the turning of the number disks to the combination set. The operating handle is thereby released. Simultaneously with the displacement of the operating handle, the number disks are turned by the cams associated with them into a given basic position which differs from the combination. Therefore, the combination cannot be noted when the permutation lock is open. Depending on the combination, the amount by which the number disks are turned differs. The combination can therefore not be discovered by the fact that the number disks are turned back by an equal amount. Unpermitted opening of corresponding containers is therefore made considerably difficult. As cam, there is particularly suitable a disk having a cardioid circumference, the turning thereof being effected by the application to the outer circumference of a turning movement which is other than radial. Therefore, there is always assurance that the number disks enter into a given basic position which differs from the combination. In this connection, the disk having the cardioid circumference is so associated with the number disk that the actuating force never acts on the tip of the cardioid. One version is characterized by the fact that the action on the cardioid-shaped cam is obtained by means of a bar-shaped spring element. Continuous action on the cam is then present. As an alternative, however, action is possible by a lever which is swung by the displacement of the operating handle and comes against the circumferential surface. Simultaneously with the displacement of the operating handle, the number disk is disengaged in favorable manner so that the catch engagement does not act to impede the rotation of the number disks. The disengagement is suitably effected by the displacement of a spring tongue extending tangential to the circumference of the number disk by means of a slide which is moved upon displacement of the operating handle. In the open position of the permutation lock, this disengaged position is maintained by the slide. The bar-shaped spring elements or the levers cooperating with the cam then prevent unintended turning of the number disks. The slide, which effects the disengagement, extends approximately parallel to the rotation shaft. In this connection, the rotation shaft bears the number disks alongside of each other. The window slide which is driven along by the operating handle serves for the displacement of the slide, in the manner that the plane of movement of the slide is transverse to the plane of movement of the window slide. In this connection, there is such a coupling between the latter and the slide that the movement is obtained by means of a pin/slot control with idle stroke present at the start of the movement. Therefore, the window slide can be displaced by a certain amount which corresponds to the idle stroke without disengagement of the number disks taking place. It is furthermore provided in accordance with the invention that blocking sleeves having flats are associated with the number disks and that the center bars of the window slide are developed as spring-loaded flap bridges which extend in the blocking direction out over the flats, with control inclines lying in the rearward-travel direction on the flap bridges. Only after the predetermined combination has been set can the bars of the window slide therefore pass over the flats of the locking sleeves. If one of the number disks is not properly set, the facing bar comes against the locking sleeve and prevents further displacement of the window slide. Therefore, the bars of the window slide can only pass the locking sleeves or the flats thereof when the combination is properly set. Together with this, there is displacement of the slide, disengagement and turning of the number disks via the cardioid cams. The return of the slide into the closed position is then permitted by the control inclines of the bars which are spring-urged into blocking direction. They then move over the locking sleeves which were previously turned together with the number disks and thereupon assume their blocking position with respect to them. In order to be able to effect the control of the spring-loaded bars upon the return travel with less friction, each locking sleeve forms, on the flank thereof facing the number disk, starting from the region of the flattening, a tapering of the cross section which declines in frustoconical shape. In order to change the combination, a combination resetting device is provided which is blocked in the open position of the operating handle by the closing of the passage of the setting lever by means of a projection on the window slide. Therefore, even when the combination lock is in open position, resetting of the combination can be effected only if one knows the combination which was previously set. A change in the combination requires bringing the permutation lock into the closed position with the container open. The number disks are then turned in accordance with the combination set. Displacement of the blocking sleeves is then possible by means of the setting lever, the flats passing over the central bars and the blocking sleeves coming out of engagement with the number disks. The turning thereof to the new combination is then effected. The setting lever is then returned into its starting position. The permutation lock of the invention can be favorably employed in furniture. Thus, it is possible to couple the window slide with a central lock. By means thereof, several drawers can be locked or released. Together with a displacement of the window slide a link is carried along by a coupling projection thereof and swings an angle lever. The latter is provided with a support pin for control of the central closure bar. Depending on the position of the window slide or the operating handle, the central locking bar is moved into one or the other position. Doors equipped with a turning-bar lock can also be coupled to the window slide. For this purpose, a coupling projection of the window slide acts via a link on a control lever which effects the bolt closure of the rotation bar lock. Together with a displacement of the operating handle and of the window slide, the control lever is swung into one or the other position, carrying along the rotation bar of the bar lock. Slide doors can also be equipped with the permutation lock. In such case, the coupling projection of the window slide acts via a link on the closing hook of the slide-door lock. The closing hook is swung upon displacement of the operating handle and simultaneous carrying along of the window slide. The window slide can then be of such a nature that it forms a bolt tail which extends into the turning-bar lock. A turn nut representing the operating handle acts thereon. The actuating of the permutation lock is then effected by the turning of the operating handle. An overload safety can be provided in the case of a permutation lock of modified development in the manner that the journal pin of the lever is mounted so as to yield against spring load. Therefore, it cannot happen that, with the operating handle in open position, upon action on the cam by a lever, the turning of the number disk will lead to destruction of the lock ward. Rather, upon such a rotation, the journal pin of the lever can move away against spring force. By the spring force the result is also obtained that, after possible turning of the number disk in such a case, it always returns to its neutral position. The mounting by slots is formed in a simple manner pointing towards the bottom. They make it possible, upon the entry into action of the overload safety, for the journal pin to move away in the direction towards the bottom. The spring-loading however always brings the journal pin back into its starting position, it striking the end of the slot. For instance, the spring load acting on the journal pin can be formed by bar springs which extend transverse to the housing and act on the end sections of the journal pin. Another overload safety consists of a spring-action slip clutch between window slide and operating handle/rotary nut. If the permutation lock assumes its closed position, large constraining forces cannot be introduced into the lock ward. As soon as the bars of the window slide come against the blocking sleeves and prevent further displacement of the window slide, the slip clutch, to be sure, permits further displacement of the operating handle/rotary nut so that only the bars come with a predeterminable force against the blocking sleeves. This measure is advantageous, in particular, in the case of a permutation lock actuated by a turn nut since here relatively large forces can be applied. In detail, this overload safety is developed in the manner that the rotary nut is coupled with a rotary actuating handle in the manner that a rib/groove engagement which can be disengaged against spring action is present. Control inclines associated with it permit, when the load becomes greater, an axial displacement of the rotary actuating handle relative to the rotary nut, with elimination of the rib/groove engagement. In this connection, the spring-loading is obtained by means of a compression spring arranged in a pot-shaped depression in the rotary actuating handle. This spring lies accordingly in concealed position and does not take up additional construction space. The compression spring rests against a plate arranged on the end of the rotation shaft of the rotary actuating handle. Since the rotation shaft is fixed in space, it has the result that the rotary actuating handle can shift relative to the rotary nut against the force of the compression spring. This happens when greater resistance is present in the lock ward, for instance when the combination is not properly set.

BRIEF DESCRIPTION OF THE DRAWINGS

Several embodiments of the invention will be explained below with reference to the drawings, in which.

DETAILED DESCRIPTION OF THE PREFERRED EMBODIMENTS

Figure 1:
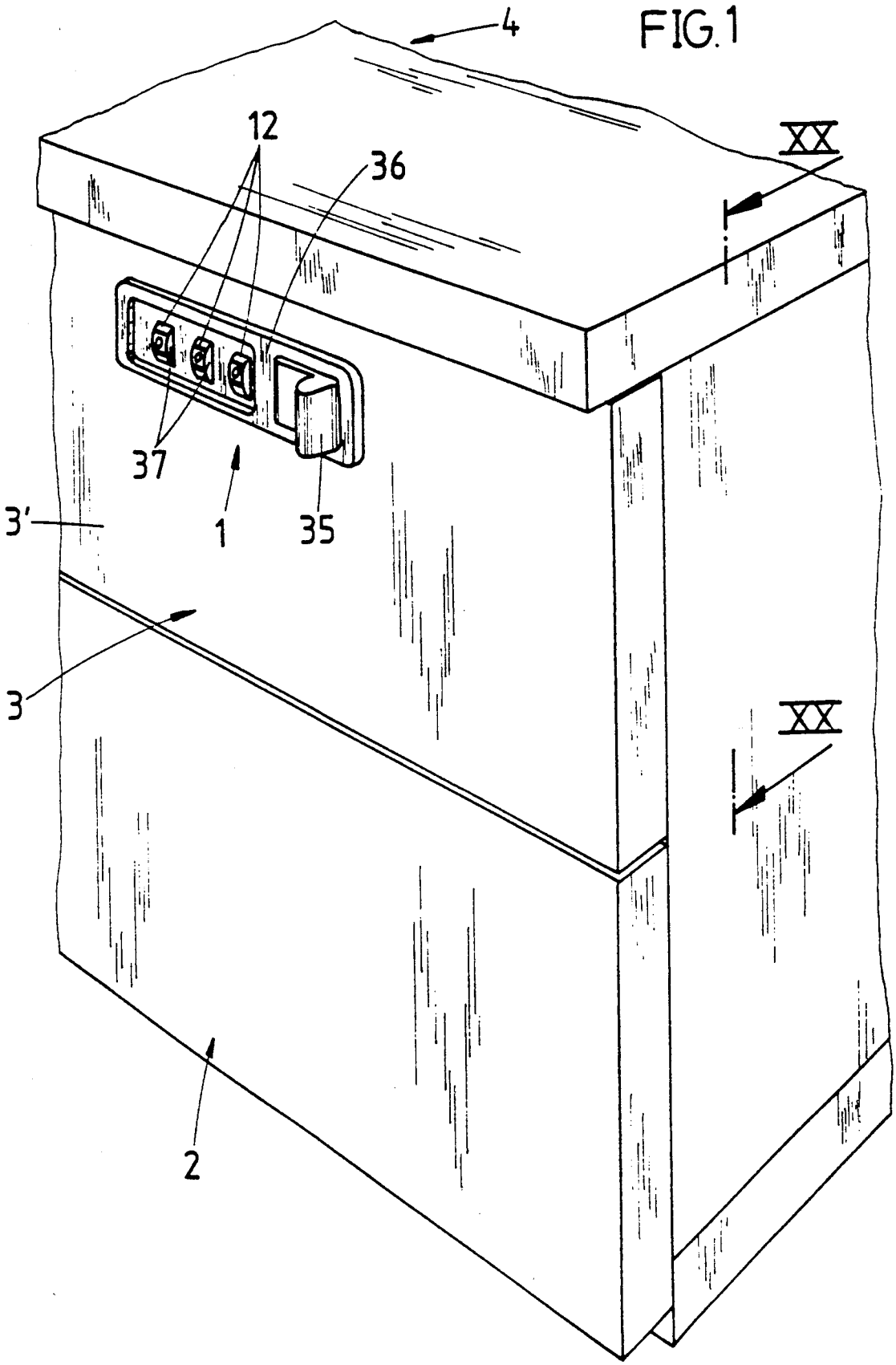
FIG. 1 is a perspective view of a piece of furniture having drawers, the upper drawer being provided with a permutation lock in accordance with the first embodiment.
Figure 2:
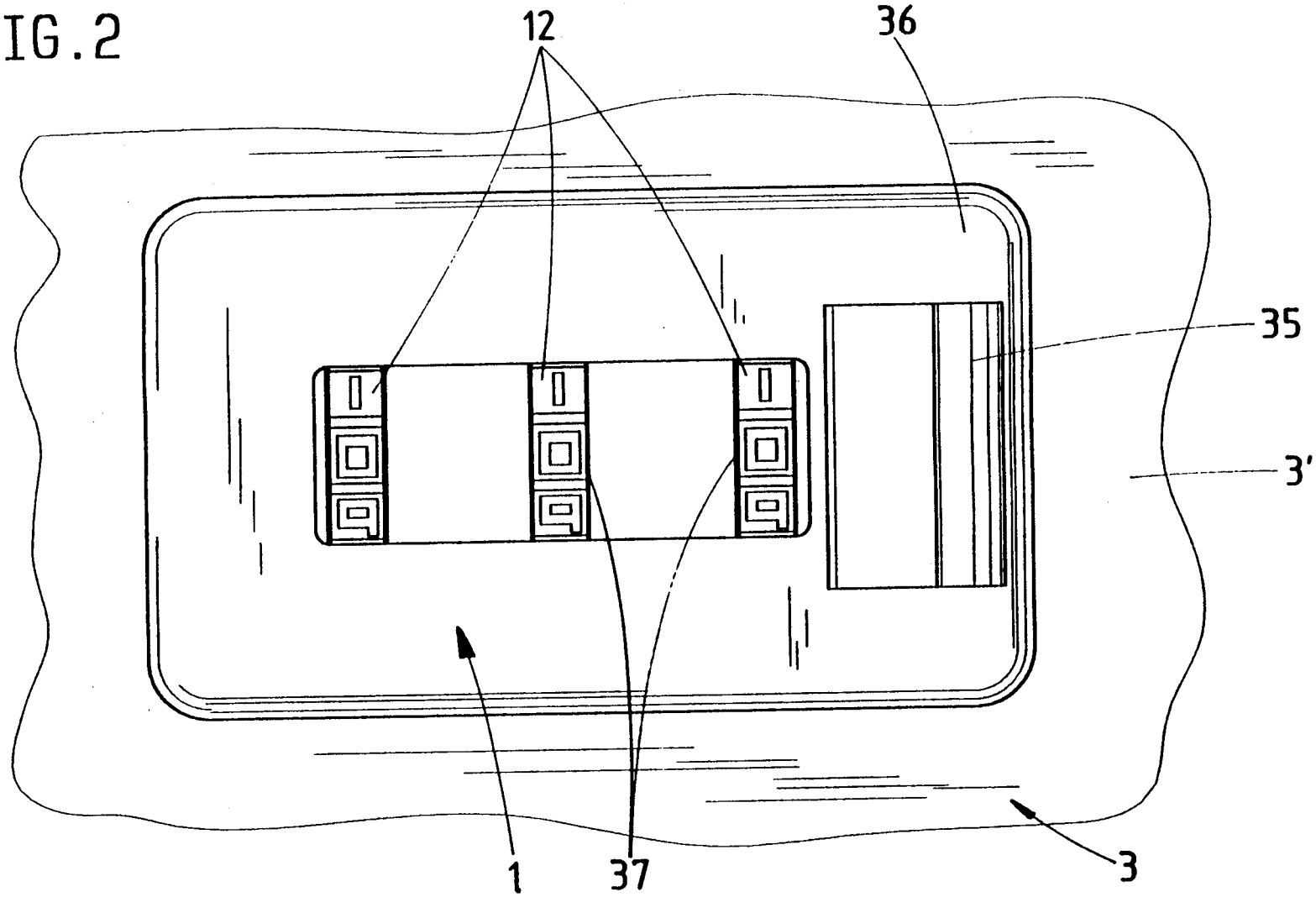
FIG. 2 is a view of the drawer in the region of the permutation lock.
Figure 3:
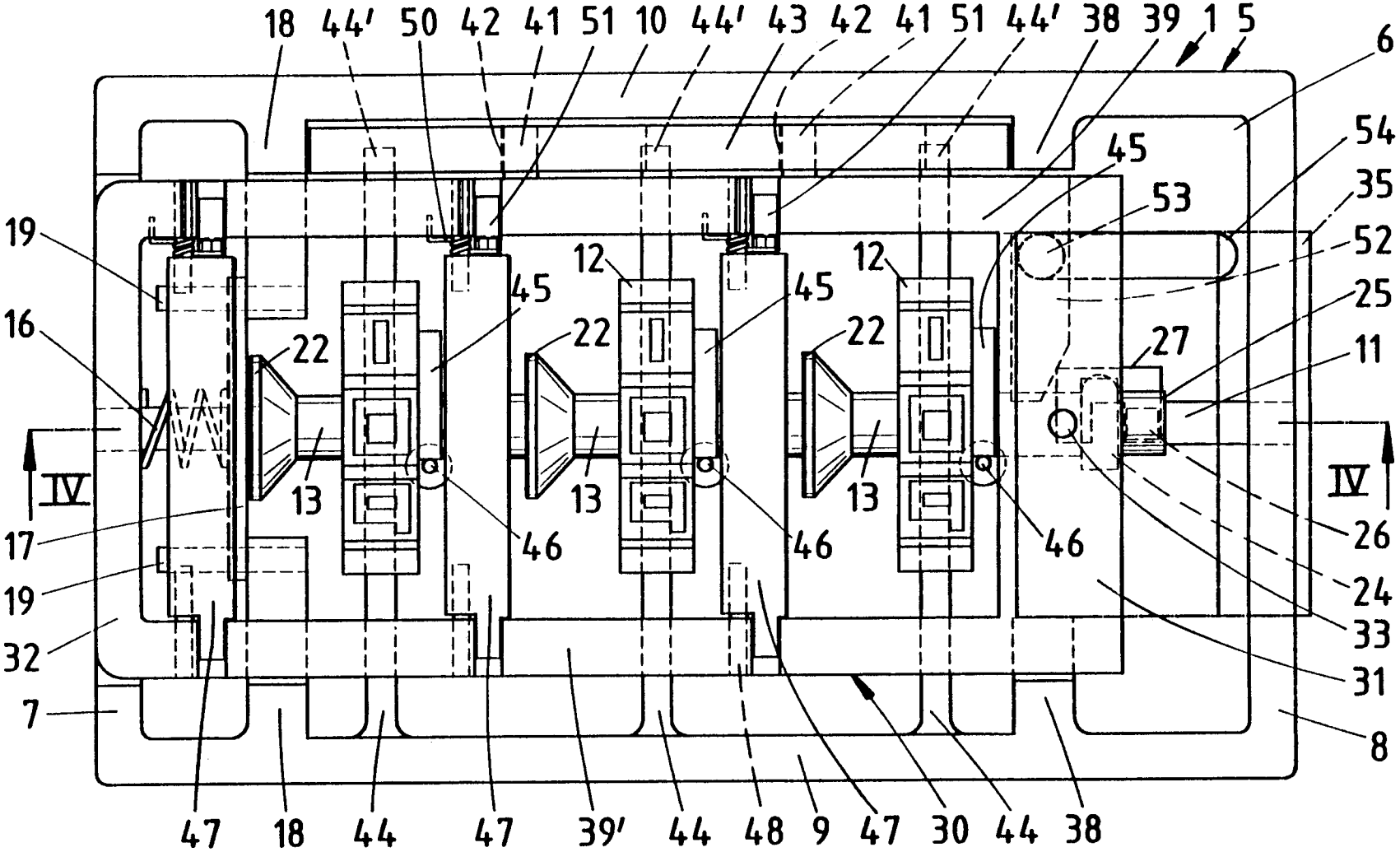
FIG. 3 is a top view of the permutation lock in its closed position, shown on a larger scale.
Figure 4:
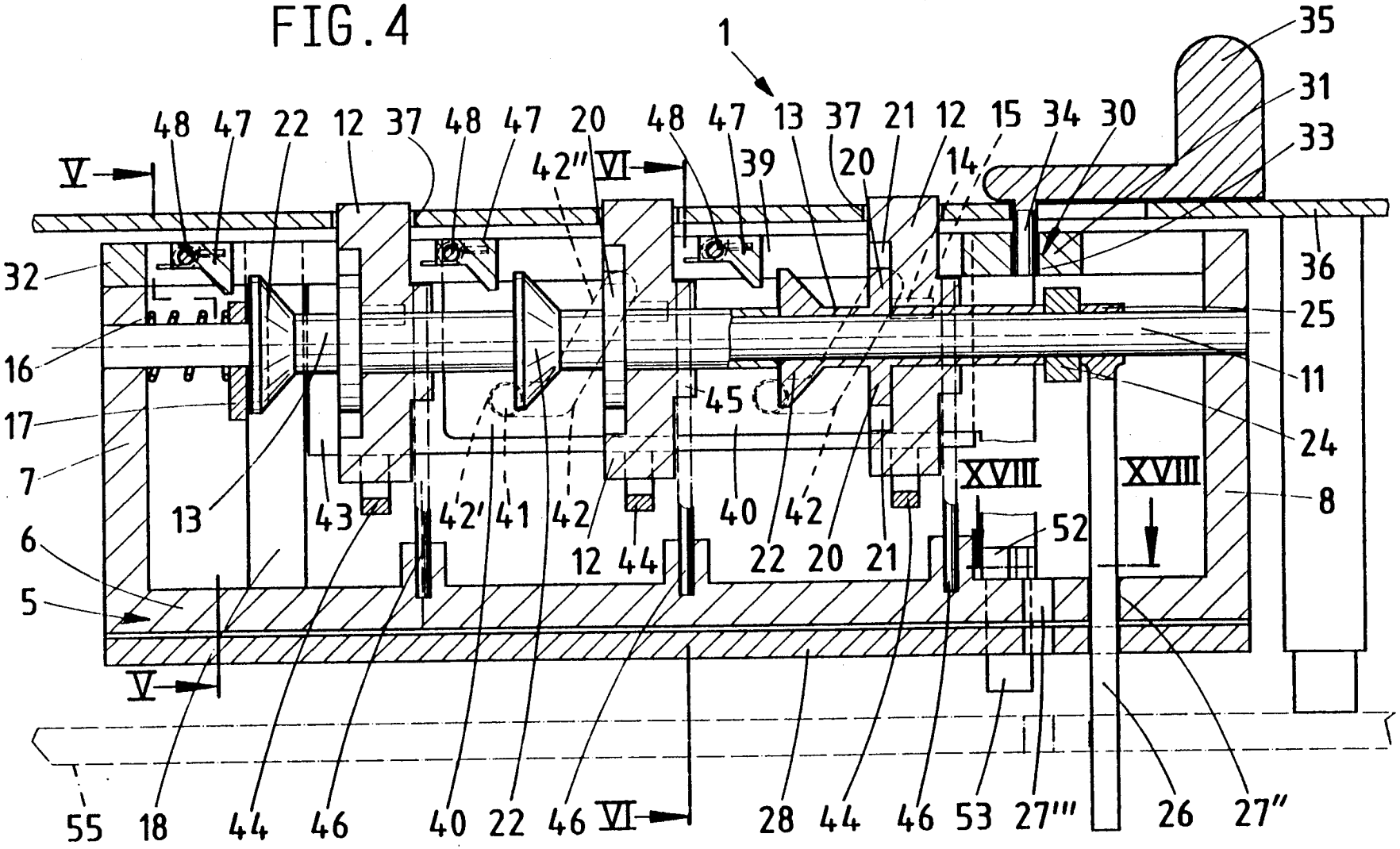
FIG. 4 is a section along the line IV—IV of FIG. 3.
Figure 5:
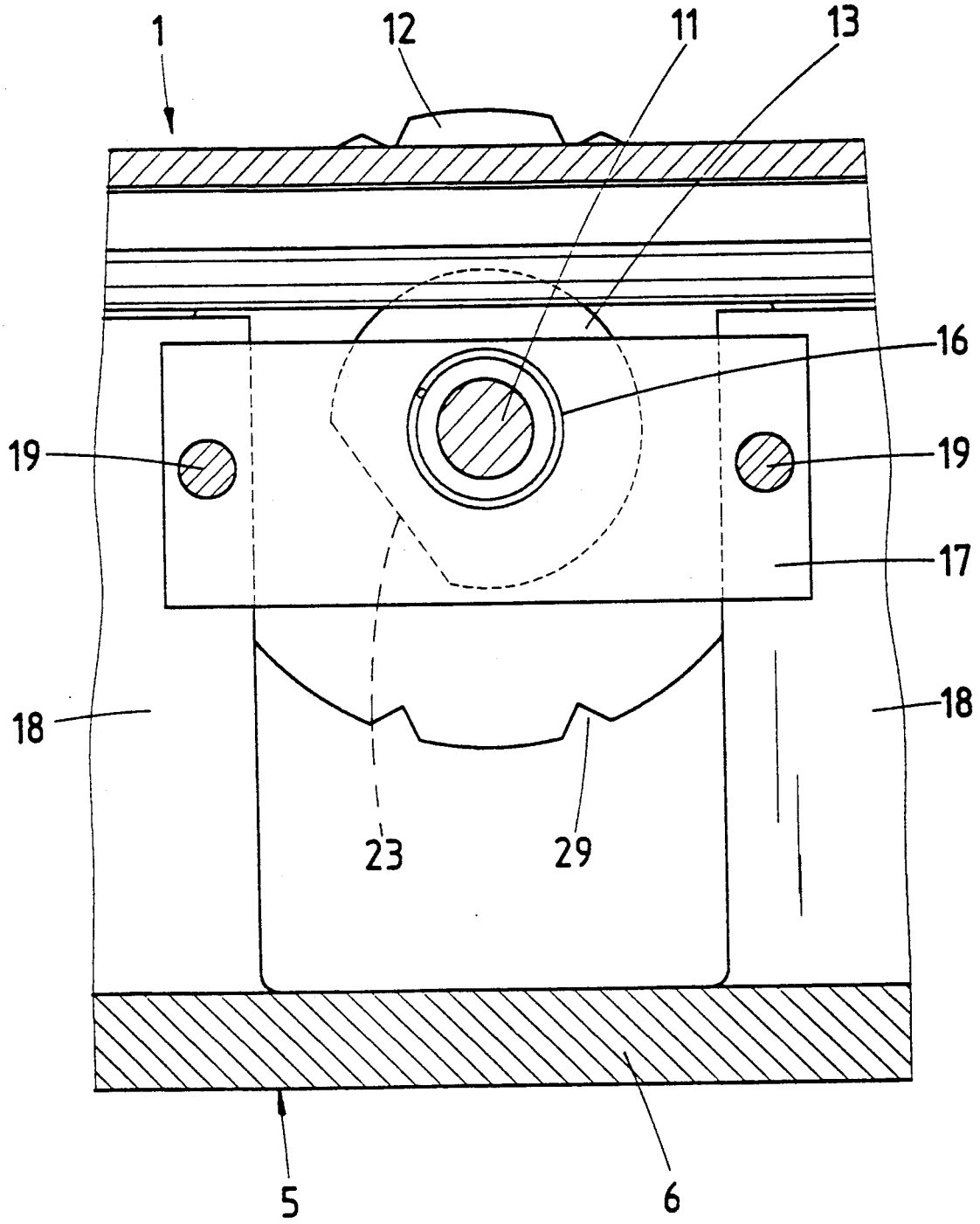
FIG. 5 is a section along the line V—V of FIG. 4.
Figure 6:
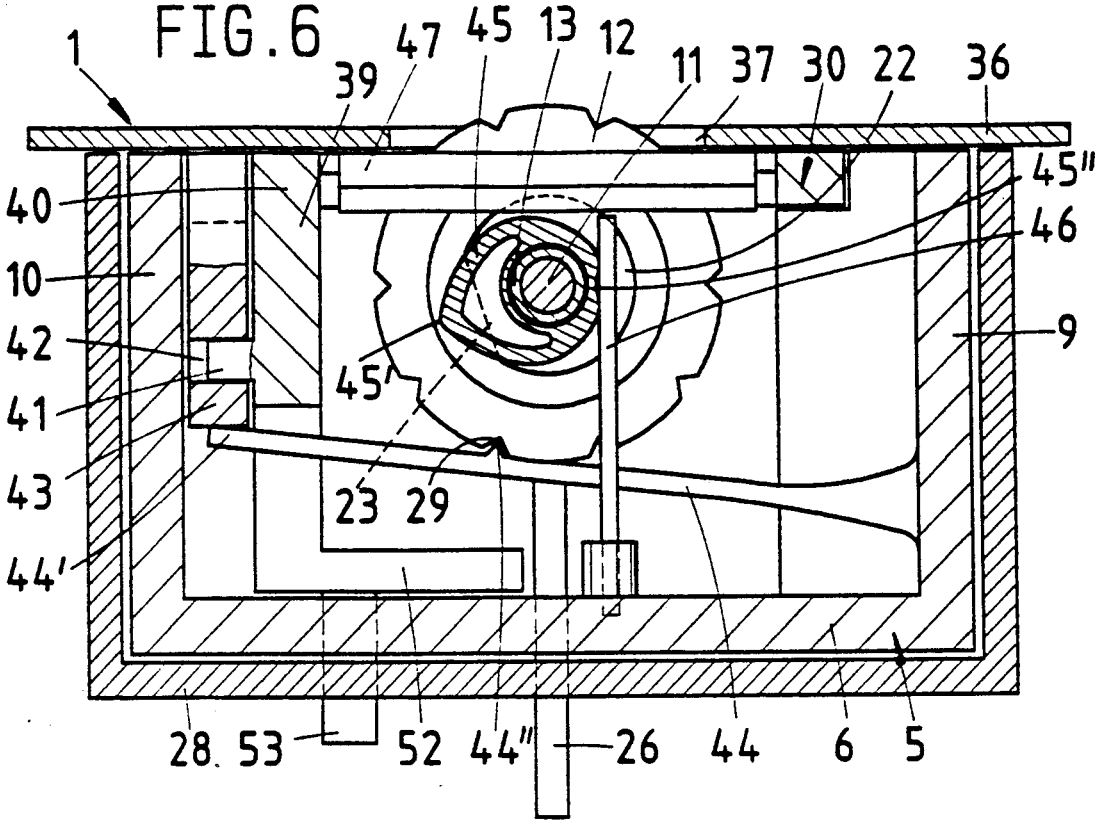
FIG. 6 is a section along the line VI—VI of FIG. 4, the number disk together with the blocking sleeve being turned into a given basic position which is different from the combination.
Figure 7:
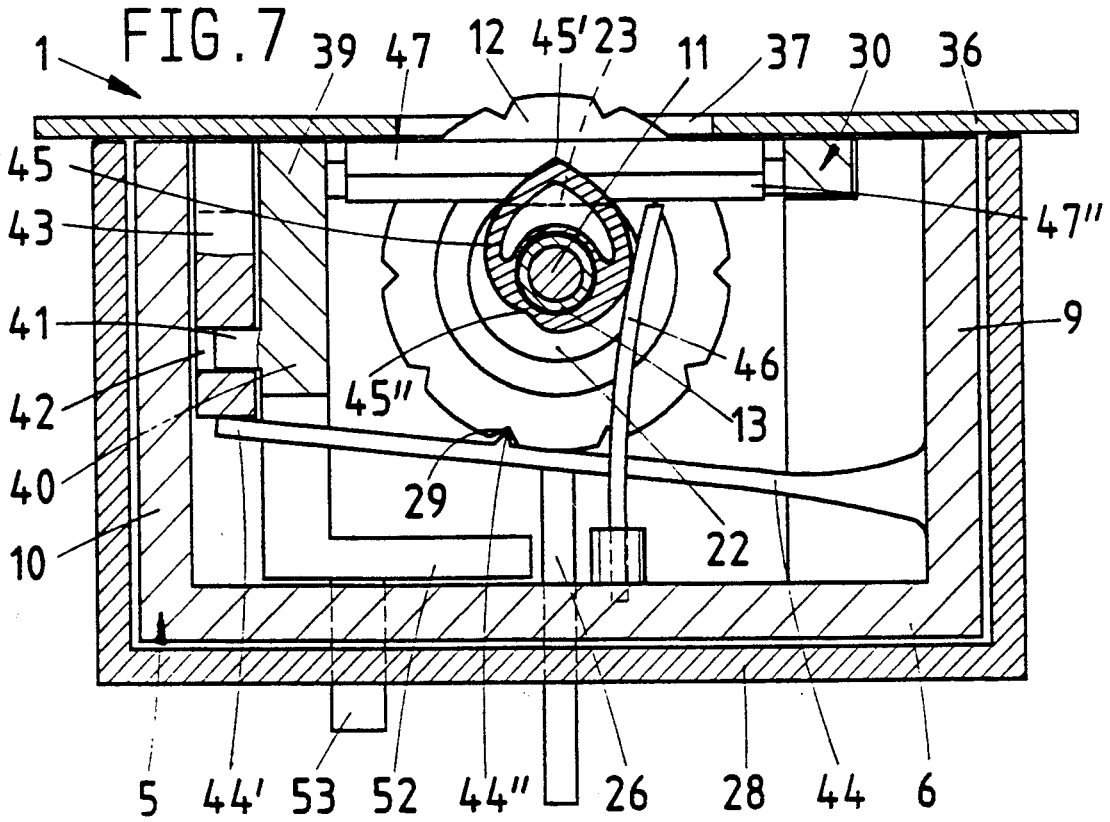
FIG. 7 is a showing similar to FIG. 6, but with the combination properly set.
Figure 8:
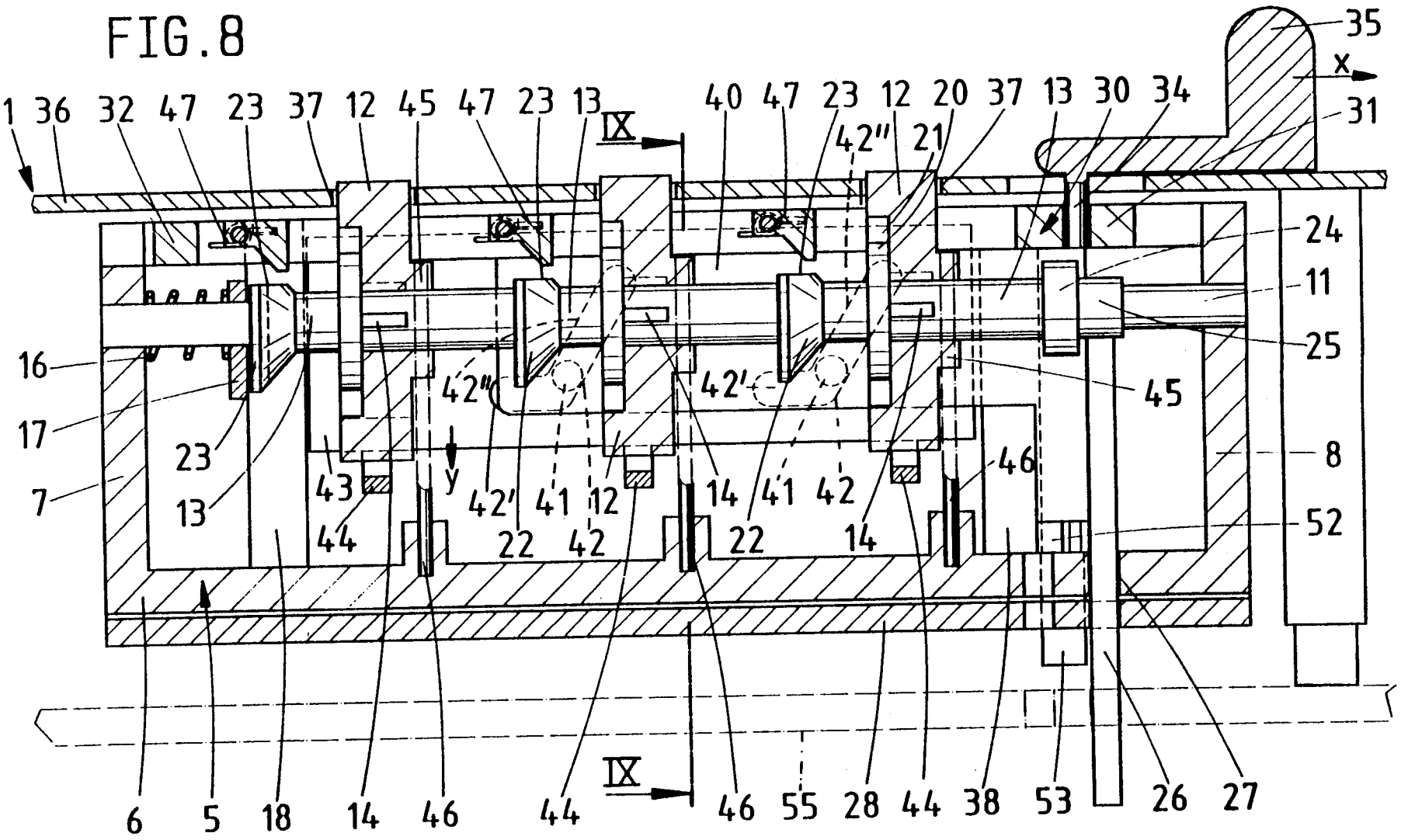
FIG. 8 is a longitudinal section according to FIG. 4 through the combination lock, but with the number disks set to the combination during the displacement of the operating handle with window slide in the open position.
Figure 9:
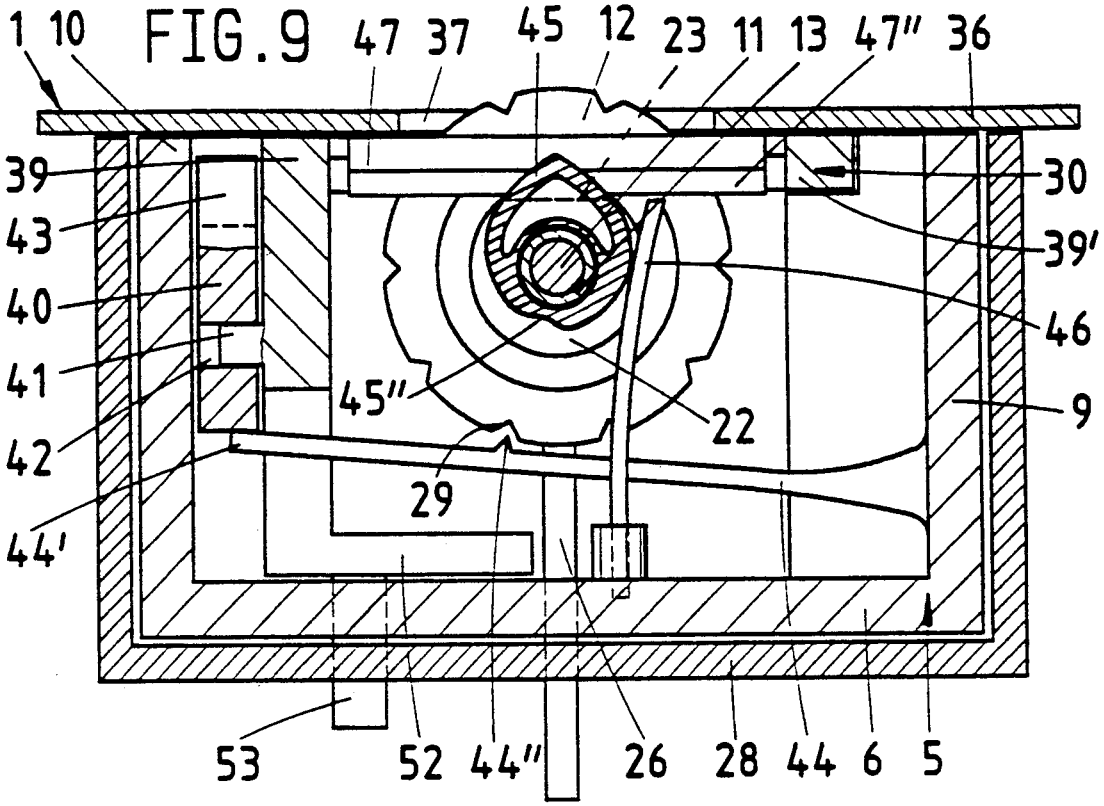
FIG. 9 is a section along the line IX—IX of FIG. 8, disengagement of the number disks being effected via the slide.
Figure 10:
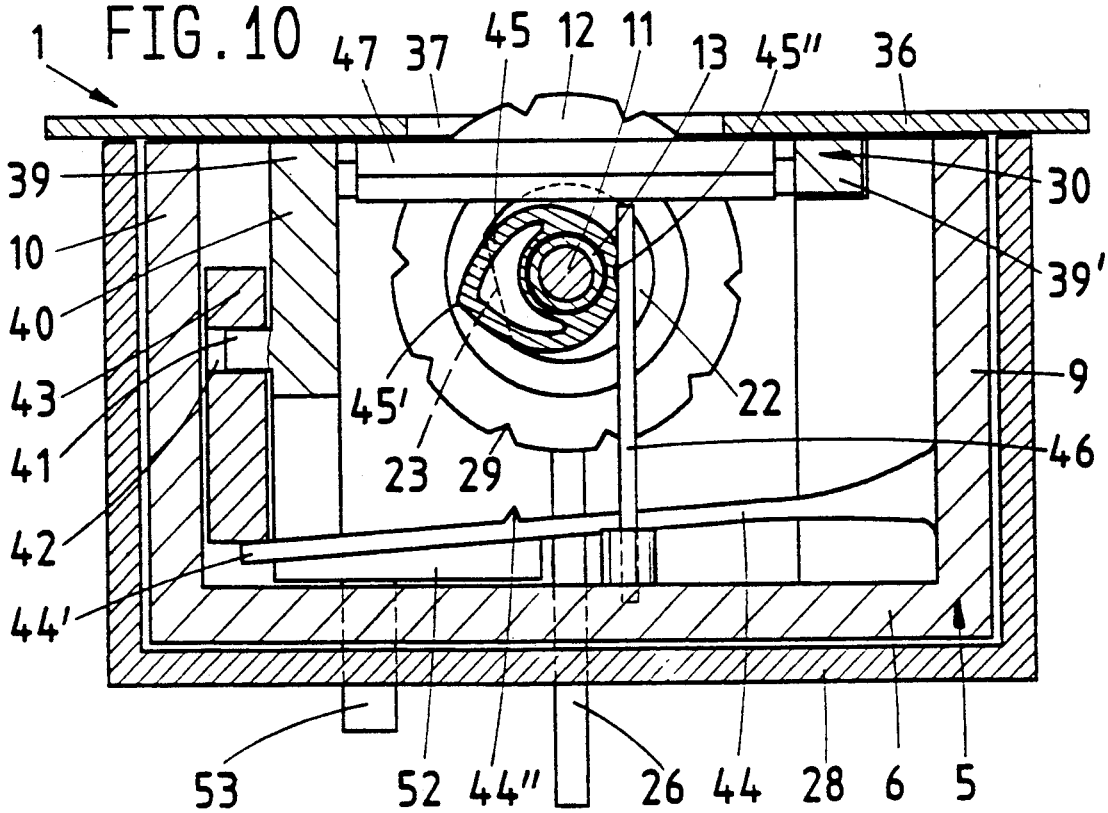
FIG. 10 is the following showing, the number disks having been turned via the bar-shaped spring elements in open position into the basic position, which differs from the combination.
Figure 11:
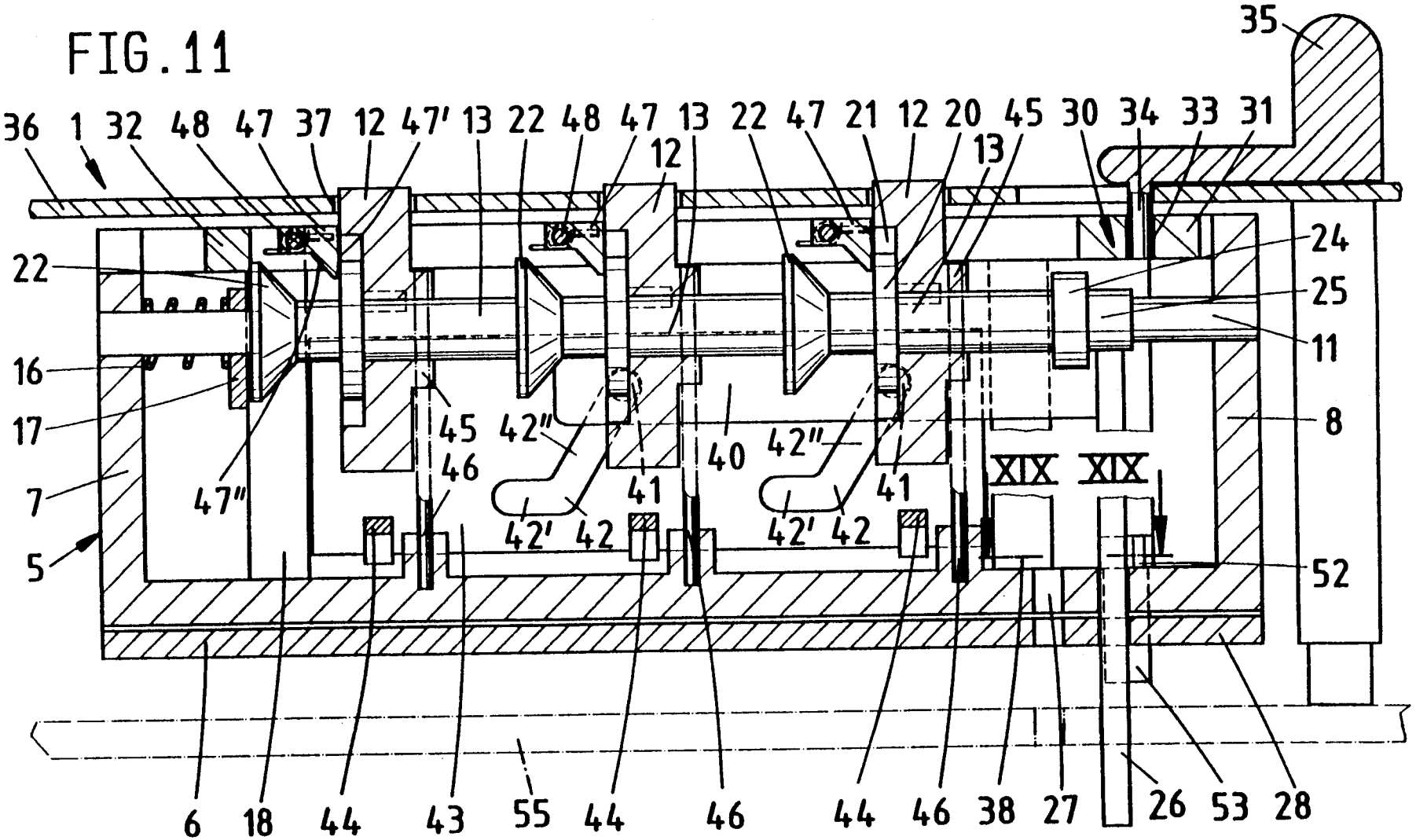
FIG. 11 is a longitudinal section through the permutation lock in its open position.
Figure 12:
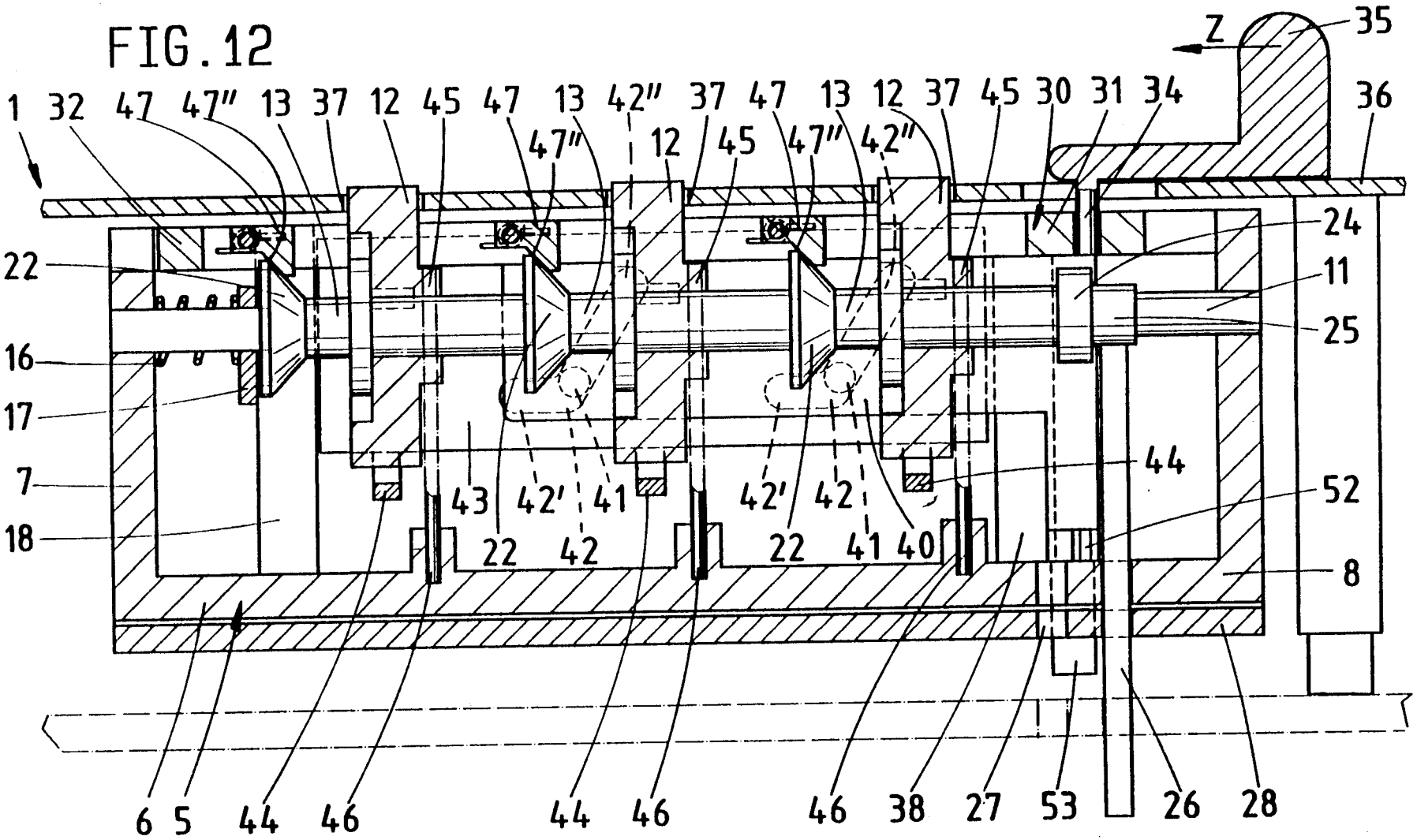
FIG. 12 is a longitudinal section through the permutation lock during the rearward displacement of the operating handle into the closed position, the central bars of the window slide coming with their control inclines against the blocking sleeves.
Figure 14:
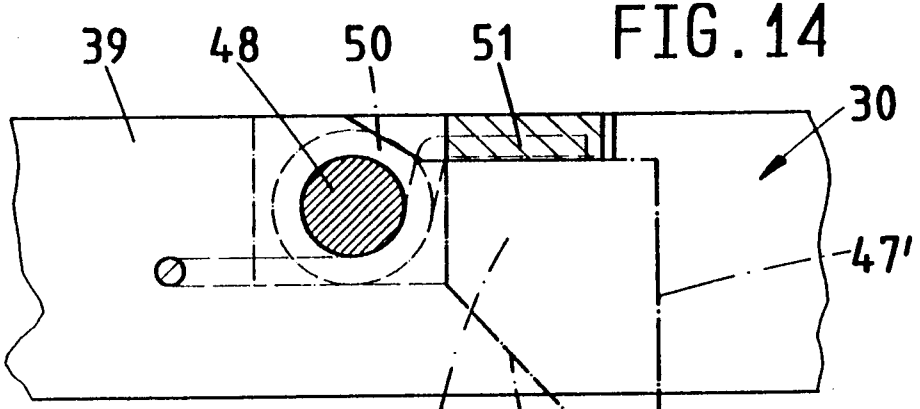
FIG. 14 is a section along the line XIV—XIV of FIG. 13.
Figure 16:
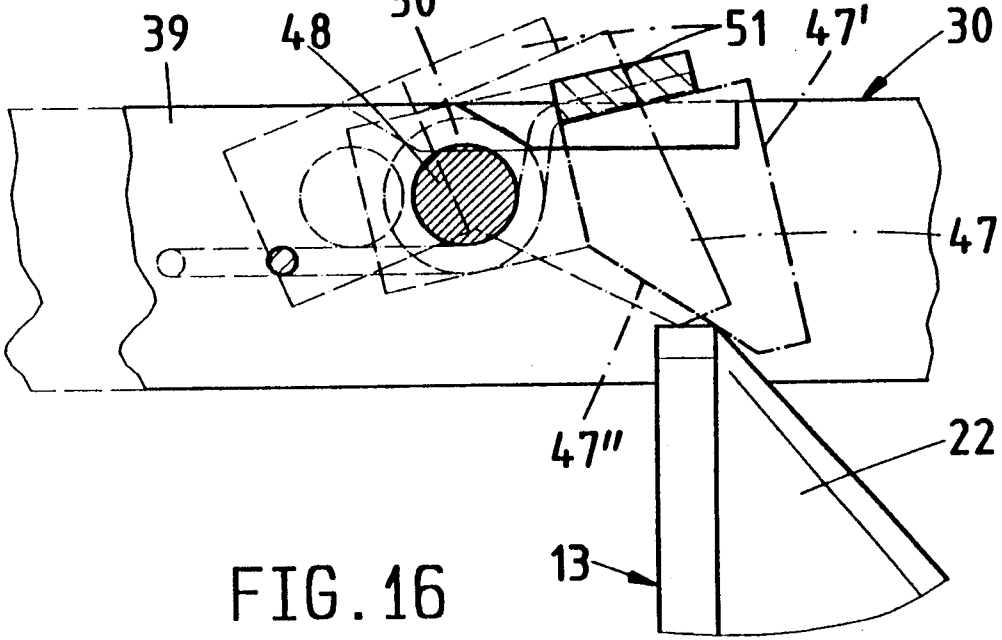
FIG. 16 is a section corresponding to FIG. 14 but with swung bar in accordance with FIG. 15.
Figure 13:
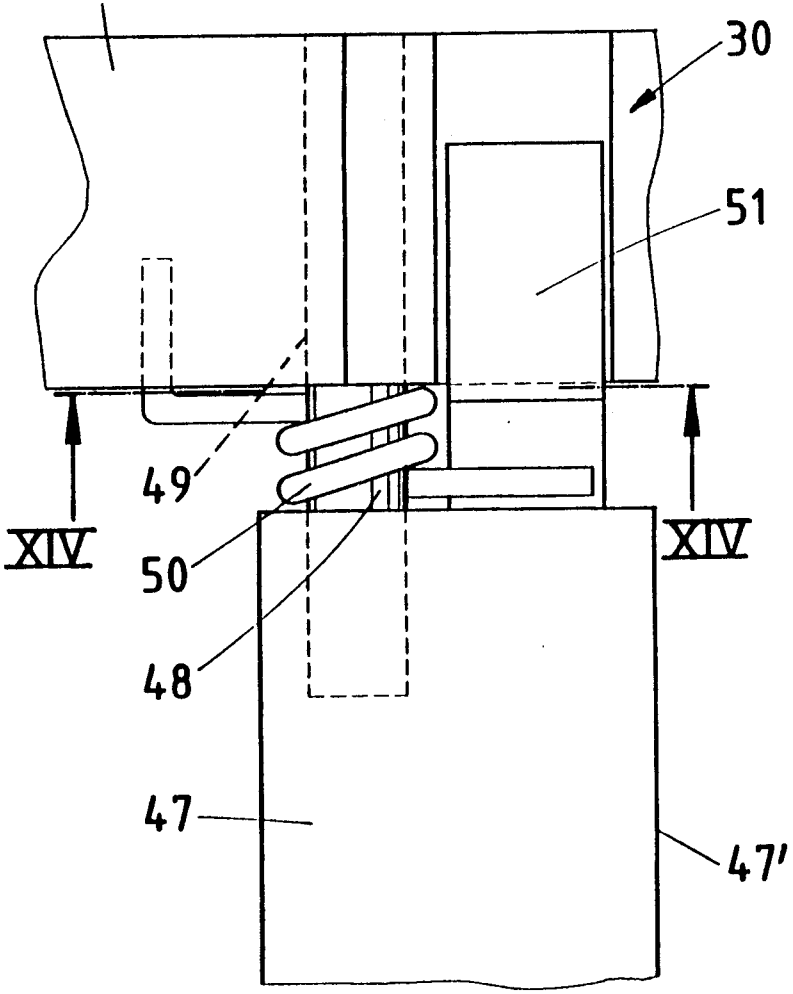
FIG. 13 is a greatly enlarged top view of the pivot place of a bar.
Figure 15:
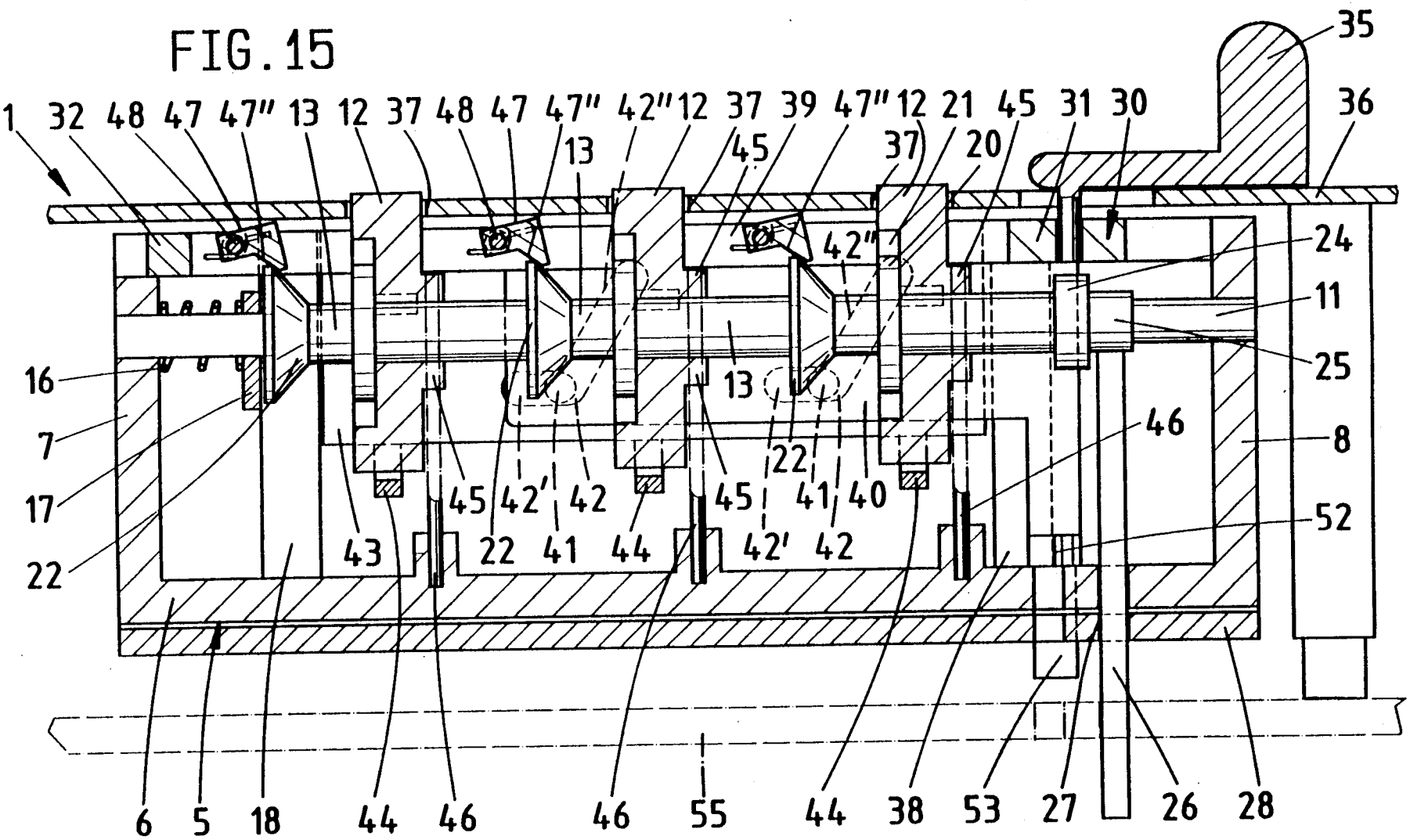
FIG. 15 is a longitudinal section through the permutation lock in another intermediate position which is obtained upon displacement of the window slide into the locked position.
Figure 17:
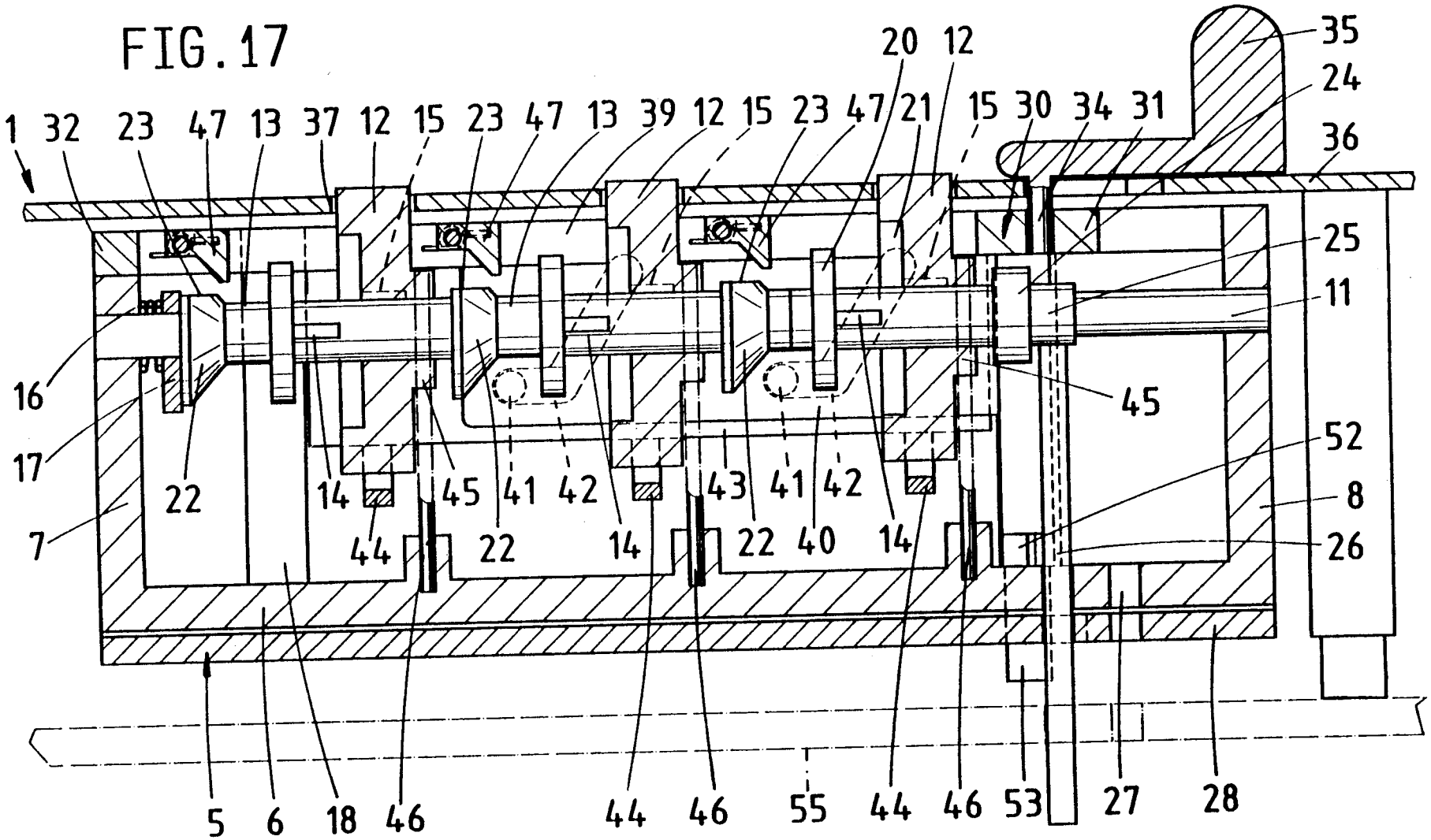
FIG. 17 is a longitudinal section through the permutation lock in its closed position, the setting lever with the locking sleeves having been displaced in order to change the combination.
Figure 18:
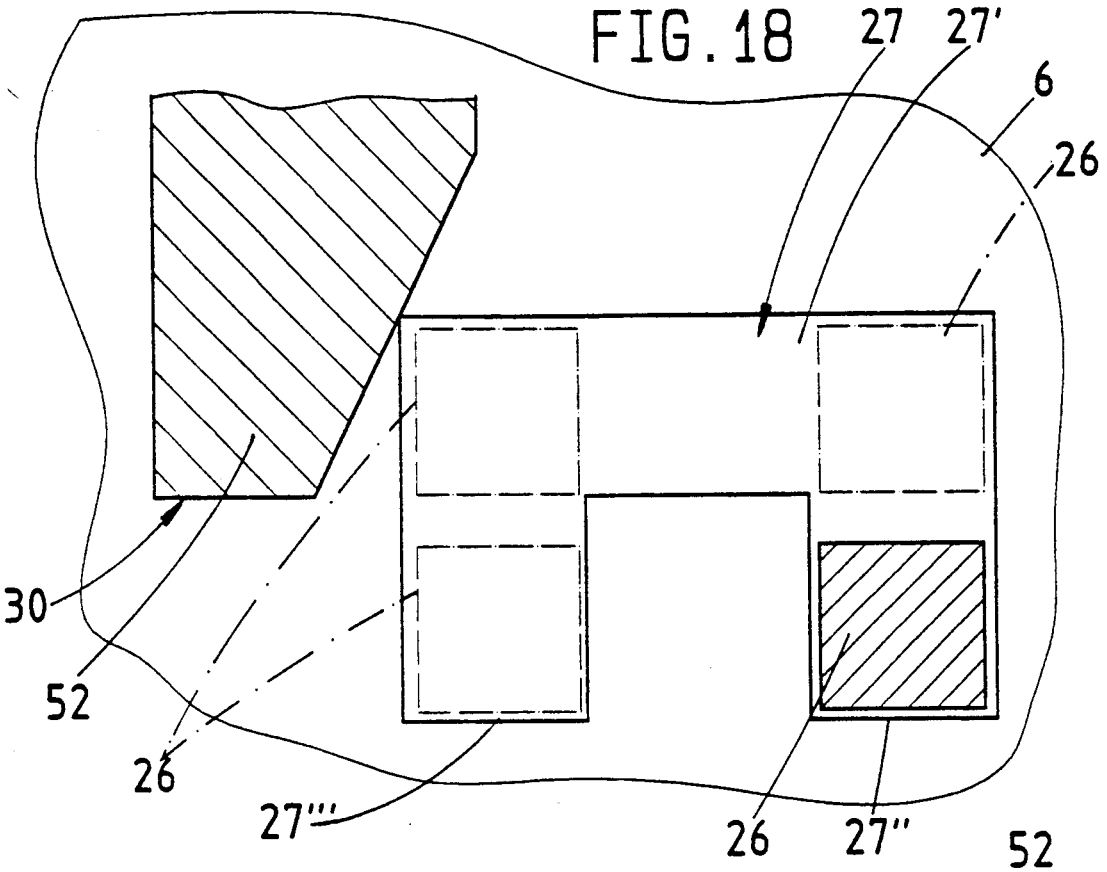
FIG. 18 is a greatly enlarged detail showing in section along the line XVIII—XVIII of FIG. 4, therefore concerning the closed position.
Figure 19:
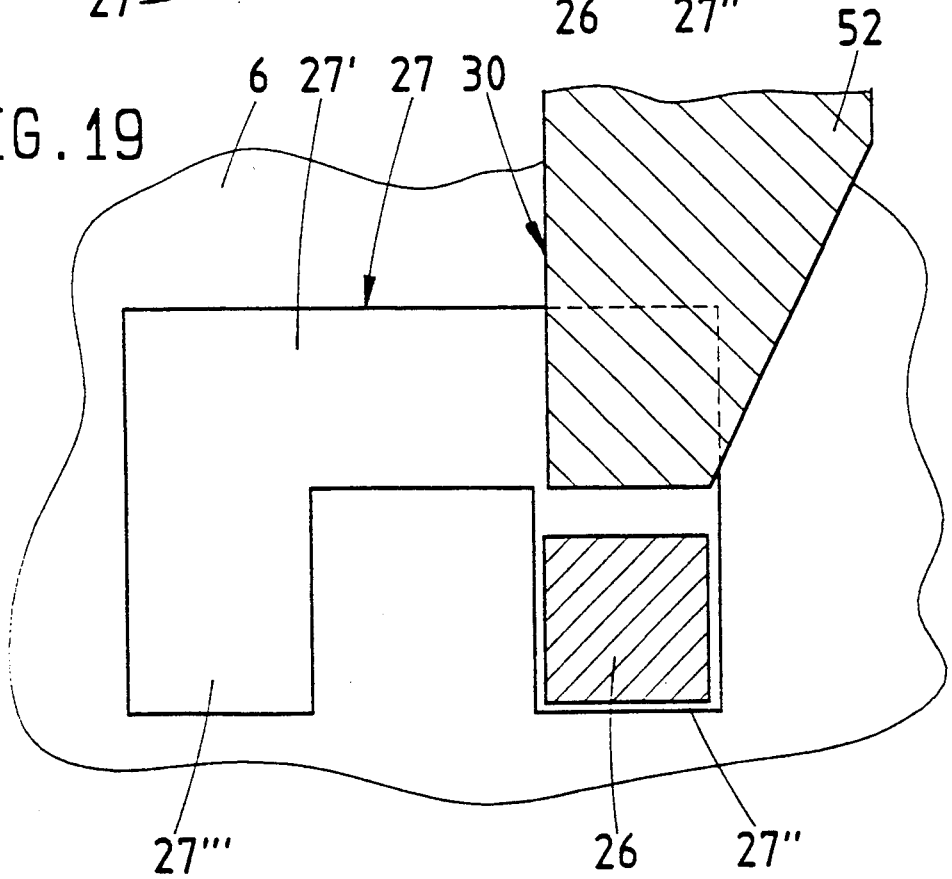
FIG. 19 is a section along the line XIX—XIX of FIG. 11, in the open position of the permutation lock.
Figure 20:
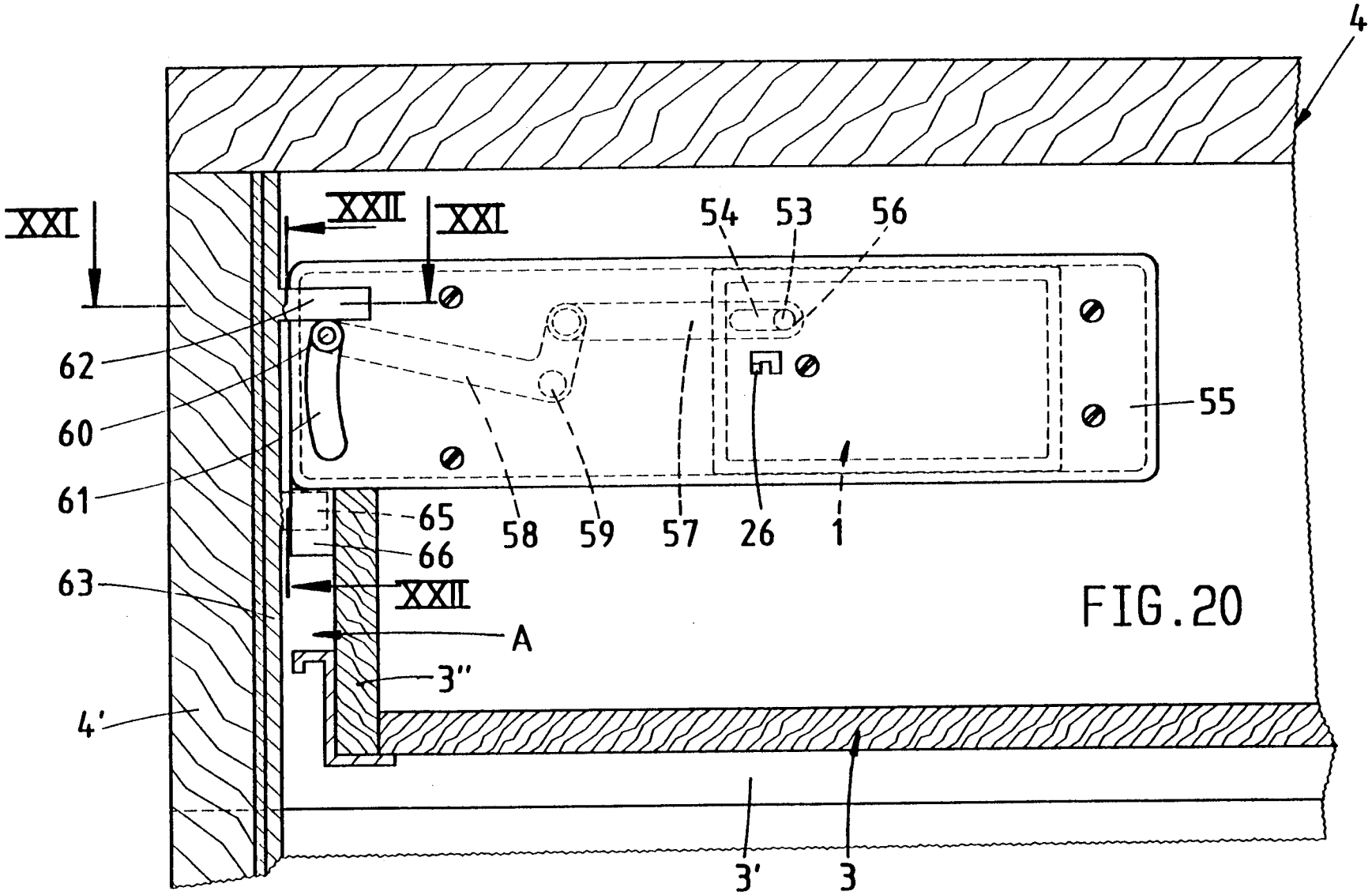
FIG. 20 is a section along the line XX—XX of FIG. 1.
Figure 21:
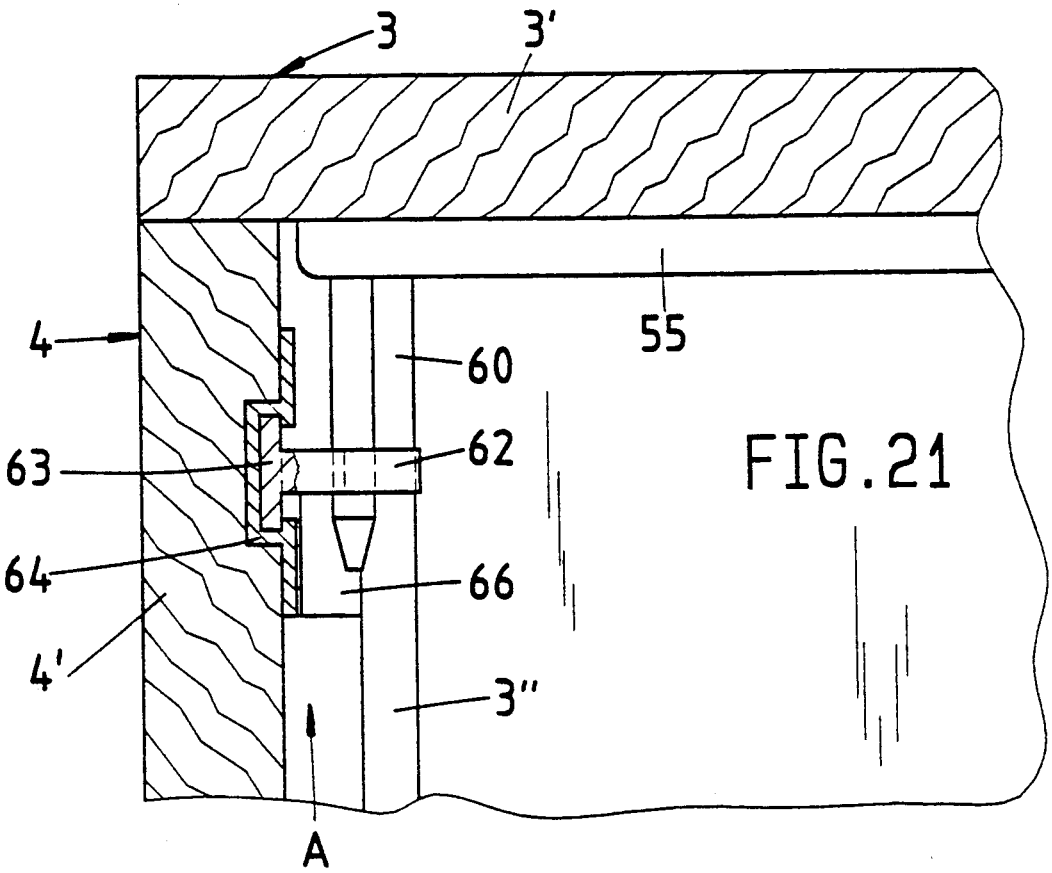
FIG. 21 is a section along the line XXI—XXI of FIG. 20.
Figure 22:
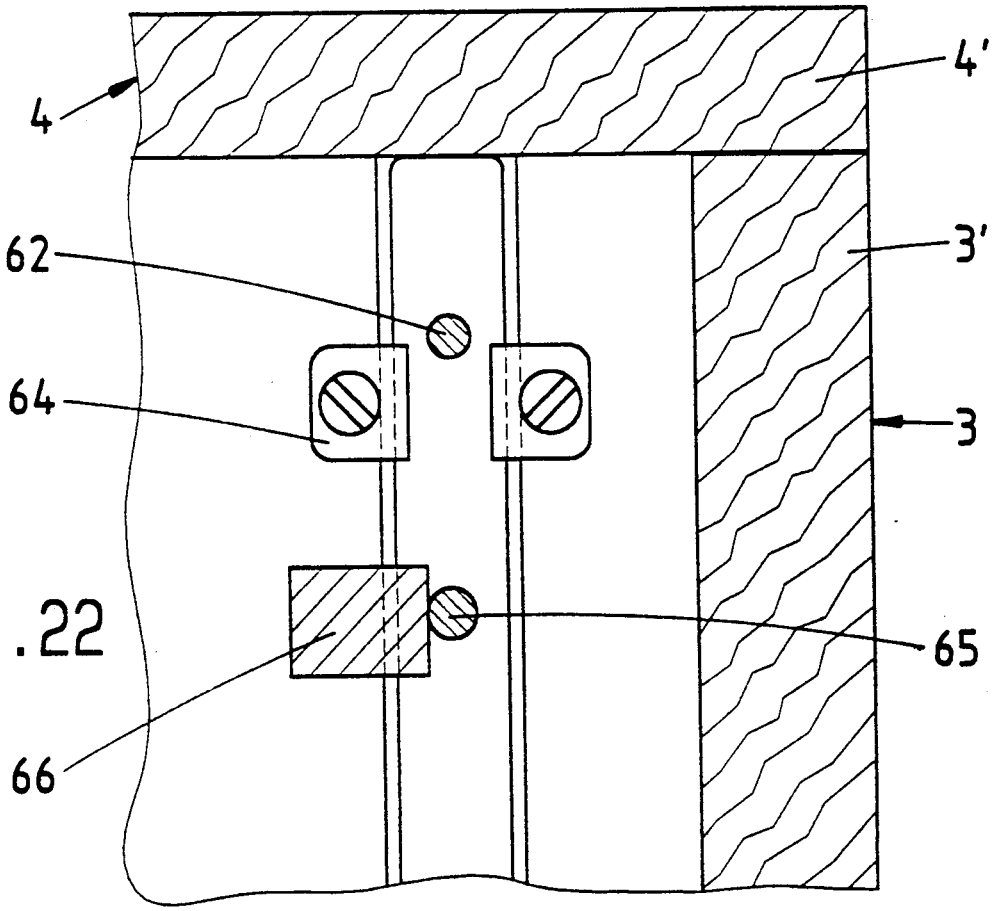
FIG. 22 is a section along the line XXII—XXII of FIG. 20.
Figure 23:
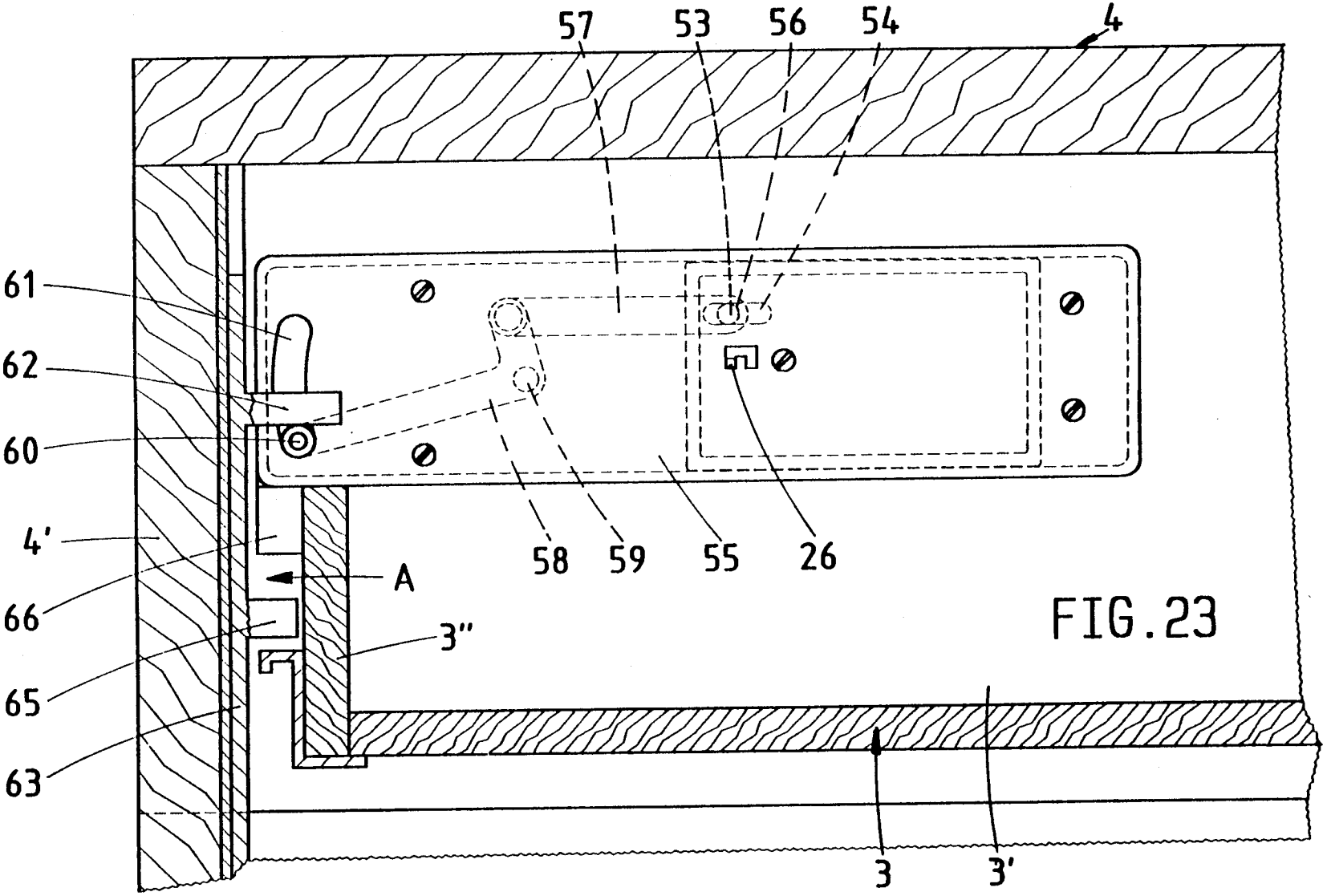
FIG. 23 is a showing corresponding to FIG. 20, but with the permutation lock in the open position.
Figure 24:
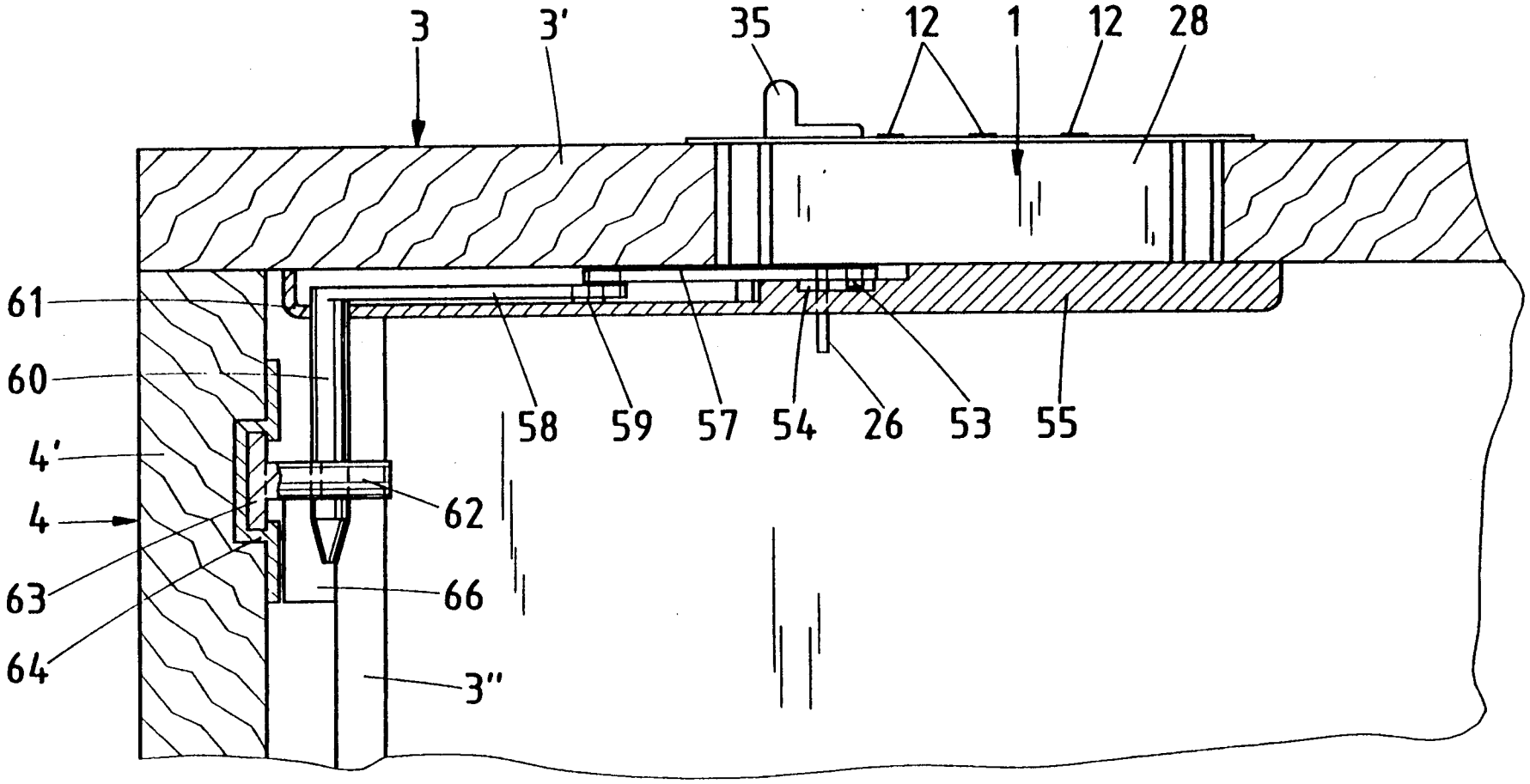
FIG. 24 is a horizontal section through the article of furniture at the height of the permutation lock, in the closed position.
Figure 25:
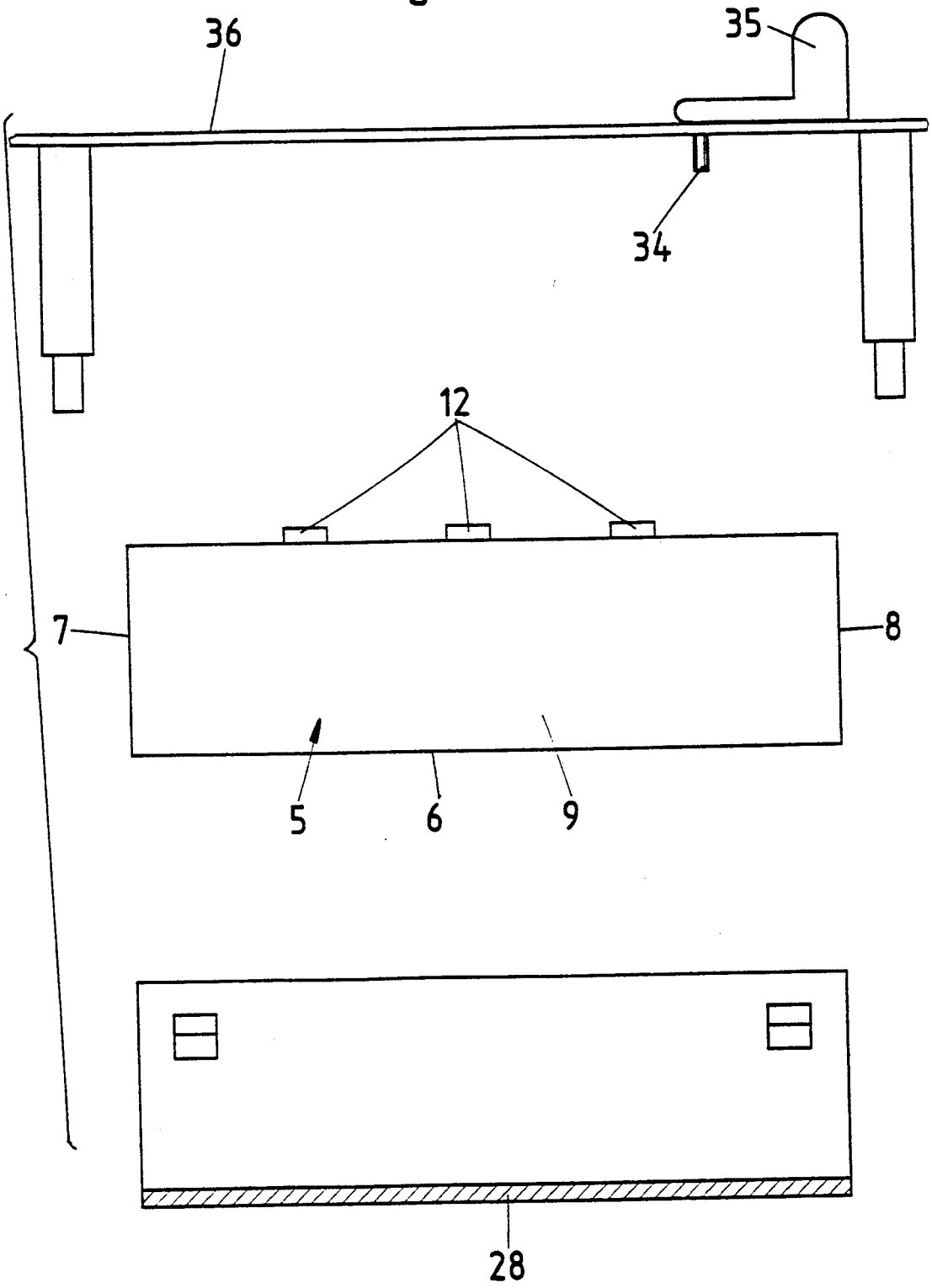
FIG. 25 is an overall showing of the cover plate of the permutation lock, the closure housing and the cover cap thereof.
Figure 26:
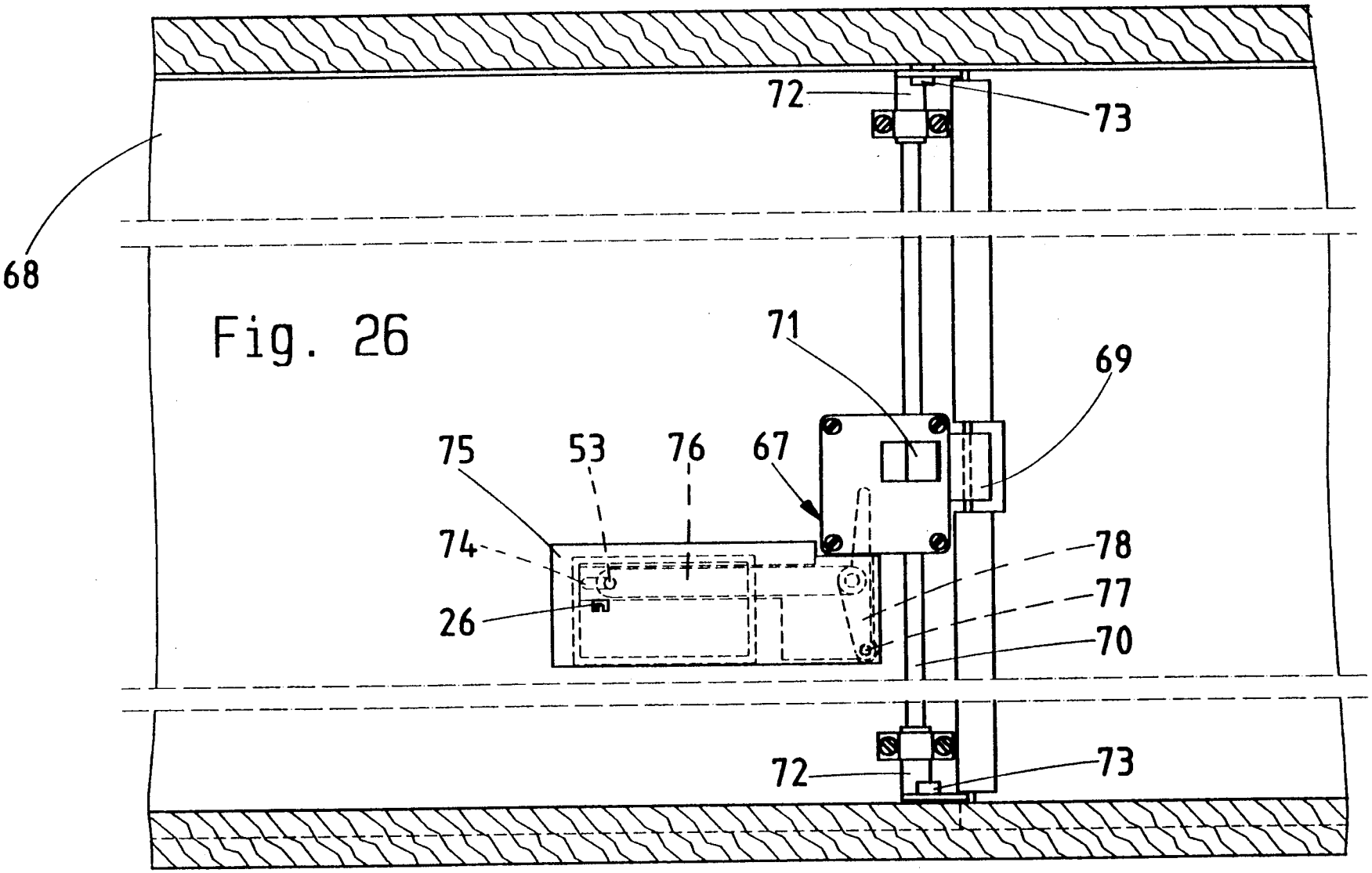
FIG. 26 is a vertical section through a differently shaped article of furniture with a view of the inside of a cabinet door provided with a turning-bar lock, which lock is coupled with the permutation lock, shown in closed position.
Figures 27, 28:
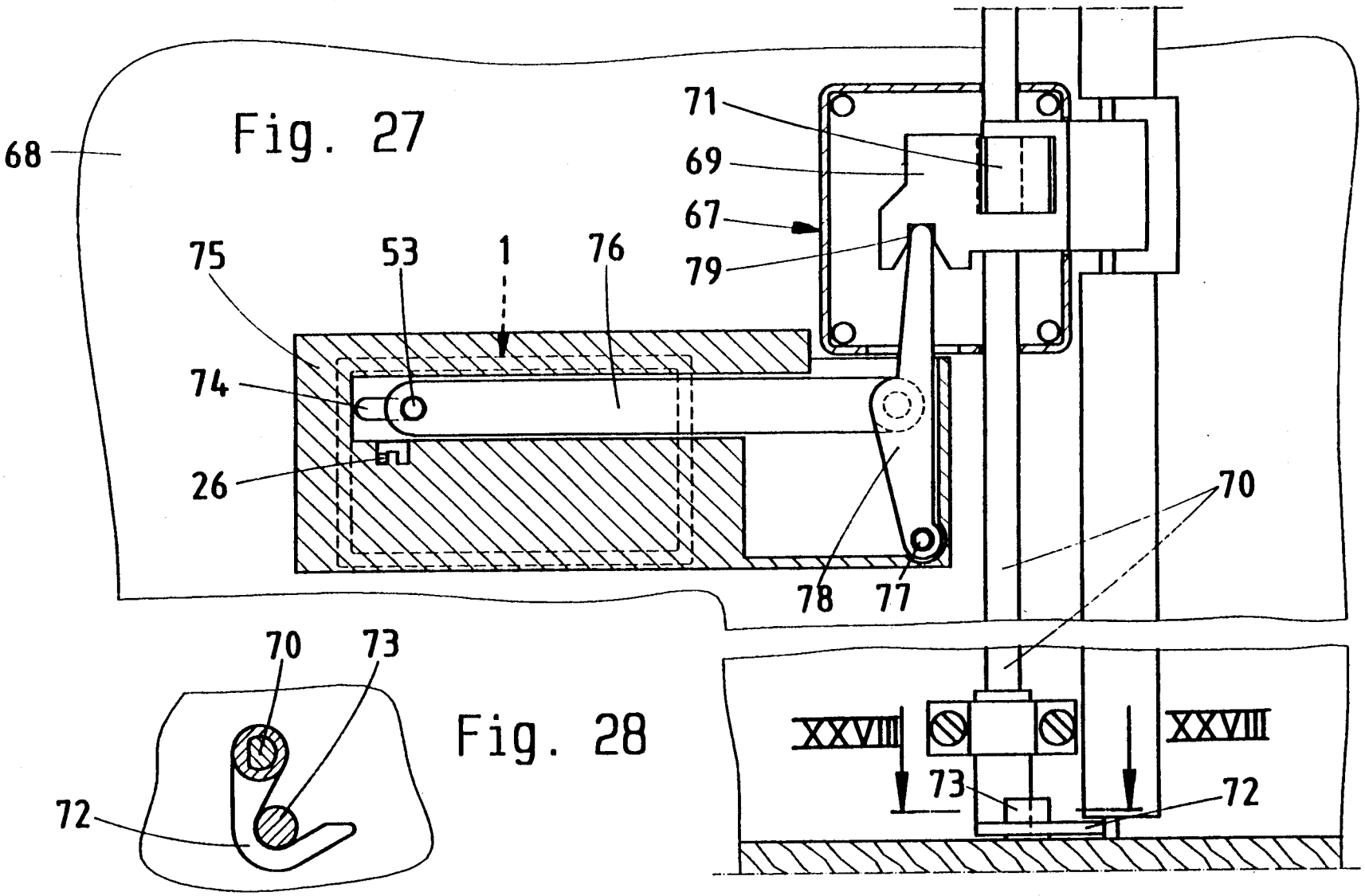
FIG. 27 is a simplified showing in section through the drive bar lock as well as the adapter housing which receives the link and the control lever.
FIG. 28 is a section along the line XXVIII—XXVIII of FIG. 27.
Figures 29, 30:
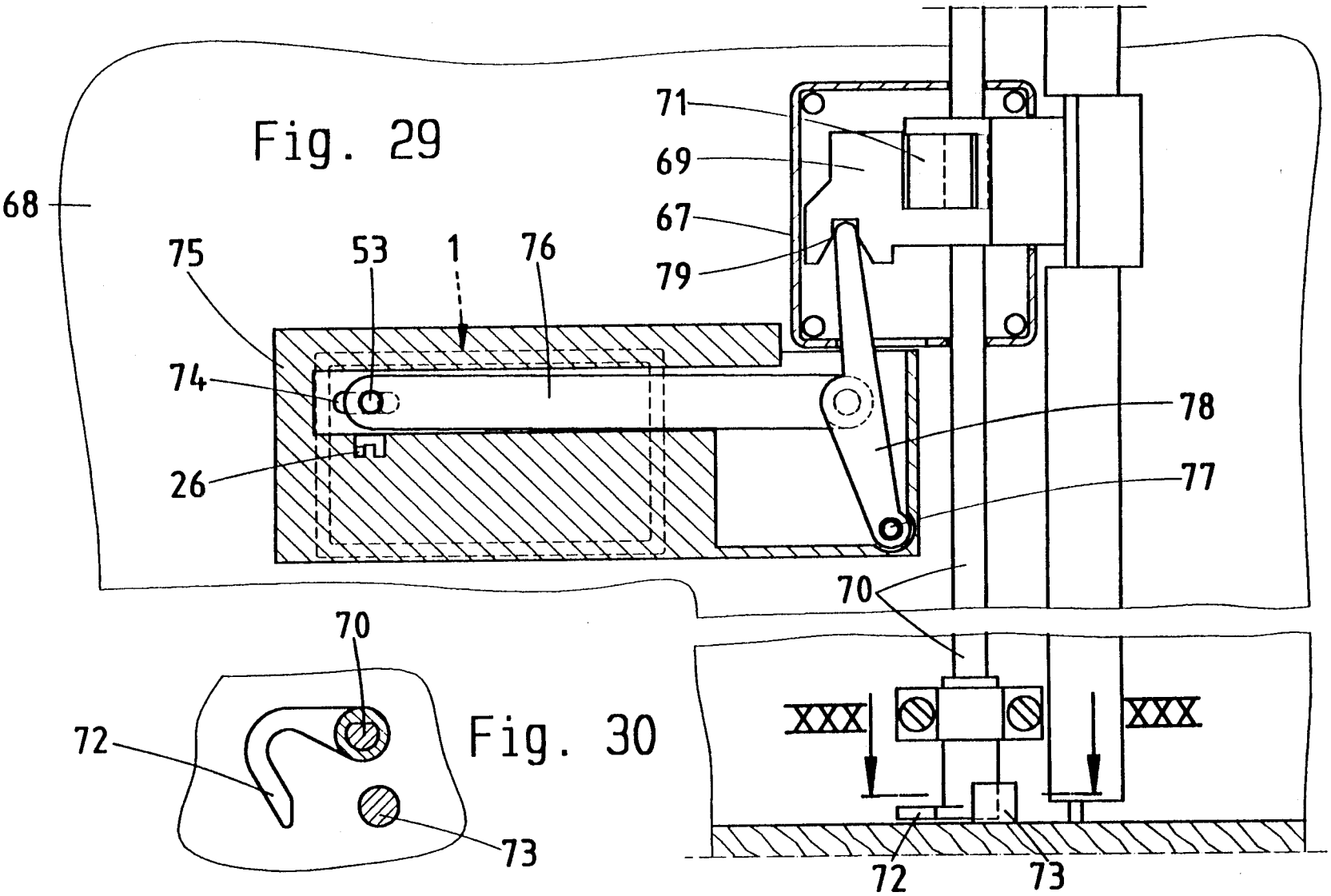
FIG. 29 is a section corresponding to FIG. 27 in open position.
FIG. 30 is a section along the line XXX—XXX of FIG. 29.

In accordance with the first embodiment, shown in FIGS. 1 to 25, a permutation lock 1 developed in accordance with the invention is provided on an article of furniture 4 having drawers 2, 3. The lock housing 5 of the permutation lock is recessed in the front plate 3'. The lock housing 5, which is developed in the form of an elongated box, has a bottom 6 with transverse side walls 7, 8 extending from it as well as longitudinal side walls 9, 10.

In the upper region, the transverse side walls 7, 8 have a nonturnable, nontranslatable rotation shaft 11 to receive numbered disks 12 of circular cross section arranged spaced alongside of each other. Each number disk 12 is in coupling tooth engagement with, in each case, a blocking sleeve 13 arranged turnably on the rotation shaft 11, said sleeve engaging through a central hole in the number disk 12 so that indirect support thereof on the rotation shaft 11 results. In order to produce the coupling engagement, a radially directed projection 14 extends from each blocking sleeve 13, it engaging in form-fitting manner into a tooth gap 15 of the number disk 12. Ten such tooth gaps are provided, arranged equally apart circumferentially on each number disk 12 so that the blocking sleeve 13 can assume ten different positions with respect to the number disk 12.

A compression spring 16 arranged on the free end of the rotation shaft 11 urges the blocking sleeves 13 via a plate 17 in the direction of engagement. The displacement of the plate 17 is limited by two webs 18 directed towards the inside of the housing which extend from the longitudinal side walls 9, 10. Pins 19 which are present in the webs and pass through the plate 17, serve in this connection as a turn lock for the plate 17. The webs 18 see to it that the spring force resulting from the plate 17 resting on them does not act further on the blocking sleeves 13. In the coupled position of the blocking sleeves 13, radially protruding collars 20 of the blocking sleeves 13 engage in form-fitting manner into depressions 21 facing them on the wide sides of the number disks 12.

Each blocking sleeve 13 has an annular collar 22 of frustoconical shape integral with and extending from it, which is provided with a flattening 23. The cross-sectional taper points in this connection in the direction of the number disk 12 which is coupled with it.

All blocking sleeves 13 are so arranged on the rotation shaft 11 that they abut against each other. The blocking sleeve 13 facing the transverse side wall 8 has an intermediate ring 24 associated with it. The bearing lug 25, arranged displaceably on the rotation shaft 11, of a setting lever 26 comes against said ring, the lever passing through a U-shaped slot 27 in the bottom 6 of the lock housing 5. A cutout of a cover cap 28 of U-shaped cross section which grips over the lock housing 5 from the bottom is aligned with the slot 27. The slot 27 is formed of a slot section 27' parallel to the rotation shaft 11 and of two slot sections 27'' and 27''' arranged at a right angle to said section 27'. Solely for changing the combination, the setting lever 26 is moved from the slot section 27'' into the slot section 27'''; see the dash-dot showing in FIG. 18. Displacement of the setting lever 26 effects a displacement of the blocking sleeves 13 against spring action, the coupling engagement between the radially directed projections 14 of the blocking sleeves 13 and the number disks 12 being eliminated. The number disks can then be brought into a different position of rotation and, after the return of the setting lever 26 into its initial position, come into coupling engagement, the flats 23 of the blocking sleeves 13 entering into a different position with respect to the number disks 12.

Each number disk 12 is provided on its circumference with ten detent cutouts 29 arranged an equal angle apart. Between them, each number disk bears the digits 0 to 9 corresponding to the ten different coupling positions of the blocking sleeves 13 with the number disks 12. When the combination is properly set, the number disks 12 are so turned with the blocking sleeves 13 that the flats 23 thereof face away from the bottom 6 of the lock housing 5 and extend parallel to a window slide 30. The latter is developed in the shape of a frame and is of shorter length than the lock housing 5. The one cross arm 31 of the frame is wider than the other frame cross arm 32 and forms, at its center, a hole 33 for the engagement of the coupling pin 34 of an operating handle 35. Between the latter and the window slide 30, there is a masking plate 36 which grips over the lock housing 5 and is provided with cutouts 37 in aligned position with the number disks 12.

The window slide 30 is supported both by the webs 18 and by further webs 38 of the lengthwise side walls 9, 10. The frame longitudinal arm 39 facing the longitudinal side wall 10 is continued in direction inward towards the housing by a bend 40. This bend is provided with two pins 41 which are arranged one behind the other at the same height and face in the direction of the longitudinal side wall 10, the pins engaging in angle slots 42 in a slide 43. The latter is guided between the webs 18 and 38 and between the longitudinal side wall 10 and the bend 40. The slide 43 thus extends parallel to the rotation shaft 11 and, upon displacement of the window slide 30, is shifted by the operating handle 35 transverse to the plane of movement of said slide.

The angle slot 42 is formed of a short slot section 42' directed parallel to the rotation shaft 11 and a longer slot section 42'' which extends in ascending fashion with respect thereto. In the closed position of the permutation lock (see, in particular, FIGS. 3 and 4), the pin 41 is at the end of the slot section 42'. As long as the pin 41 moves within the slot section 42', the slide 43 is not displaced. There is thus an idle stroke of the window slide 30 with respect to the slide 43.

Each number disk 12 has, associated with it, a detent lever 44 the free end 44' of which rests against the lower edge of the slide 43. Furthermore, a detent tooth 44'' of the detent lever 44 engages into a detent cutout 29 of the number disk 12. In accordance with the first embodiment, the detent lever 44 extends, integral with it, from the longitudinal side wall 9 of the lock housing 5, which is preferably made of suitable plastic.

Each number disk 12 forms a cam 45 on the wide surface opposite the depression 21. This cam is developed as a disk of cardioid contour. The tip 45' of the cardioid cam points into the region between two detent cutouts 29 which are adjacent each other. On the cardioid bottom 45'' which is opposite the cardioid tip and which is either flat or recessed, a bar-shaped spring element 46 rests. The spring element 46 is anchored in the bottom 6 of the lock housing. Therefore, the component of force exerted by the spring element 46 can never be introduced into the cardioid tip 45'.

The blocking sleeves 13 cooperate with central bars 47 of the window slide 30. In the closed position (see, in particular, FIGS. 3 and 4), the bars 47 extend a slight distance in front of the annular collar 22 of the blocking sleeves 13. The bars 47 are supported by journal pins 48 at their end, said pins engaging in holes of corresponding cross section in the frame longitudinal arms 39, 39'. These bars 47 are developed as flap bridges spring-urged in blocking direction, which extend over the flats 23 of the blocking sleeves 13. For the spring-loading of each flap bridge or bar 47, there is a torsion spring 50 associated with the one journal pin 48 and resting at one end against the frame longitudinal arm 39 and at the other end against a stop web 51 which engages over the latter. Each bar 47, on its side facing the operating handle 35, forms a blocking edge 47', adjoining which, at an acute angle, there is a control bevel 47'' which lies in the direction of return travel. Its angle corresponds to the frustoconically descending cross-sectional taper of the annular collar 22.

The frame transverse arm 31 bears, directed downward, a projection 52 which, in the open position of the lock, lies in front of the setting lever 26 and thus extends within the passage thereof.

A coupling pin 53 extends over the projection 52. This pin passes through a slot both in the bottom 6 and in the cover cap 28 and engages into a longitudinal hole 54 in an adapter housing 55. The latter is firmly screwed onto the rear of the front plate 3' of the drawer 3 and also connected to the masking plate 35, with the simultaneous fixing in place of the lock housing 5.

The coupling pin 53 passes through a hole 56 in a link 57 which, in its turn, pivotally acts on an angle lever 58. For the supporting thereof, there is provided a pin 59 arranged in the region of the vertex of the angle. The longer arm of the angle lever 58 bears at its end a supporting pin 60. The latter passes through an arcuate slot 61 in the housing 55, which slot is concentric to the journal pin 59, and acts on a transverse bolt 62 at the upper end of a central closure bar 63. The latter, in its turn, is guided in bearings 64 of the one side wall 4' of the article of furniture 4. Below the transverse bolt 62, the central closure bar 63 bears a locking projection 65 which, in the closed position of the permutation lock, lies in front of a laterally protruding projection 66, pointing in the direction of the side wall 4', of the one longitudinal wall 3'' of the drawer 3. The blocking of the lower drawer 2 is effected in the same manner.

The method of operation is as follows:

If the pre-established combination for the opening of the permutation lock is not set by the turning of the number disks 12 then, upon the attempt to displace the operating handle 35 in the direction of opening, the bars 47 strike against the annular collars 22 of the blocking sleeves 13. Opening requires the proper turning of the number disks 22 into the position shown in FIG. 7, in which the flats 23 are parallel to the bars 47. The operating handle 35 can now be moved in the direction of the arrow x, with the simultaneous carrying along of the window slide 30. The pins 41 of the latter pass over an idle path in the slot section 42'. During this, the bars 47 move over the annular collars 22 of the blocking sleeves 13. As soon as the pins 41 enter into the obliquely rising slot section 42'', this results in a downward movement of the slide 43 in the direction indicated by the arrow y. The lower edge of the slide strikes the spring tongues 44; see FIG. 9. The detent teeth 44'' accordingly leave the detent cutouts 29 of the number disks 12 associated with them. The tensioned spring elements 46 can now enter into action, they turning the number disks 12, via the cardioid cam 45, into a given basic position, which is different from the combination. The turning displacement is at an end when the cardioid base 45'' is opposite the spring element 46; see FIG. 10. At the same time, the blocking sleeves 13 coupled with the number disks 12 have also turned, so that their flats 23 have assumed different position. In other words, the annular collars 22 of the blocking sleeves 13 lie in the path of movement of the bars 47.

With the displacement of the operating handle 35 in the direction indicated by the arrow x into the open position, the projection 52 is carried along. It then comes into position in front of the setting lever 26. Furthermore, the coupling pin 53 extending from the projection 52 has shifted the link 47 and, via the latter, turned the angle lever 58; see FIG. 23. The supporting pin 60 at the free end of the angle lever 58 permits the lowering of the central closure bar 63. As a result, the locking projection 65 moves away from the projection 66 of the drawer 3. Only the latter, as well as the drawer 2, can be pulled out.

The locking of the drawers 2, 3 requires the closed position of the drawers. The operating handle 35 is then to be displaced in the direction indicated by the arrow z, the window slide 30 being carried along. The control bevel 47'' of the bars 47 thereof comes against the frustoconically extending flank of the annular collars 22; see FIGS. 12, 15 and 16. In this way, the bars 47, which are developed as flap bridges, are swung in opposition to the spring load. As soon as the bars have passed the annular collars 22 of the blocking sleeves 13, the bars 47 swing into their blocking position, in which they are limited by stop. With the return displacement of the window slide 30, the slide 43, by the pin/slot engagement, is moved back in the direction of the window slide, releasing the spring tongues 44, the detent teeth 44'' of which extend in form-fitting manner into the detent cutouts 29 of the number disks 12 and adjust the latter in detent fashion.

With the displacement of the window slide 30, the link 57 is also carried along via the coupling pin 53, it swinging the angle lever 58 and, by means of the supporting pin 60 and transverse bolt 62, lifting the central closure bar 63, the locking projections 65 of which come in front of the projections of the drawers 2, 3 and secure the latter.

If it is desired to change the combination which has been set, then, with the drawer 3 open, the operating handle 35 is turned from its open position into the closed position in accordance with 17. The projection 52 of the window slide 30 then permits the passage of the setting lever 26 of the combination resetting device. The free end of the setting lever 26, since it passes through a slot in the adapter housing 55 which lies with identical contour to the slot 27, can be grasped, with the drawer 3 open, and passed from the slot section 27'' into the slot section 27'''; see FIG. 18. In this connection, the blocking sleeves 13 are pushed over the intermediate ring 24, with simultaneous tensioning of the compression spring 16; see FIG. 17. The radial projections 14 of the blocking sleeves 13 come accordingly out of the engagement with the tooth gaps 15 of the number disks 12. The latter can now be turned free of detent engagement with the blocking sleeves 13, setting the new combination. If the setting lever 26 is now moved backward, the blocking sleeves 13 are now coupled to the number disks 12.

The specific basic position which differs from the combination can be of such a nature that the digits used for the evaluation are zeros.

In accordance with FIGS. 26 to 30, the permutation lock 1 cooperates with a rotary bar lock 67. The latter is fixed on the inside of a door 68. The rotary bar lock 67 has a bolt 69 as well as a bushing 71 which is passed through by the rotary bar 70. The bushing 71 is turned as a function of the closing movement of the bar 70. On the free ends of the rotary bar 70, there are locking hooks 72 which, in closed position of the permutation lock, grip behind pins 73 on the cabinet side.

The opening and closing movements of the permutation lock are transmitted by the coupling pin 53 seated on the window slide 30. This pin engages into a longitudinal slot 74 of an adapter housing 75 and is coupled with a link 76. The latter engages in pivoted manner within the central region of a control lever 78 which is swingable around the journal pin 77. The free end of the latter extends into a closure cutout 79 in the bolt 69. In accordance with FIGS. 27 and 28, the closed position of the permutation lock is present. Both the bolt 69 and the locking hooks 72 are in the locked position.

If the open position is to be brought about then, after setting the combination, the operating handle 35 of the permutation lock is turned in opening direction carrying along the window slide 30 the coupling pin 53 of which carries along the link 76 and swings the control lever 78. By the latter, the bolt 69 is pulled back and the rotary bar 70 turned, the locking hooks 72 coming into position of release with respect to the pin 73; see FIGS. 29 and 30.

Figure 31:
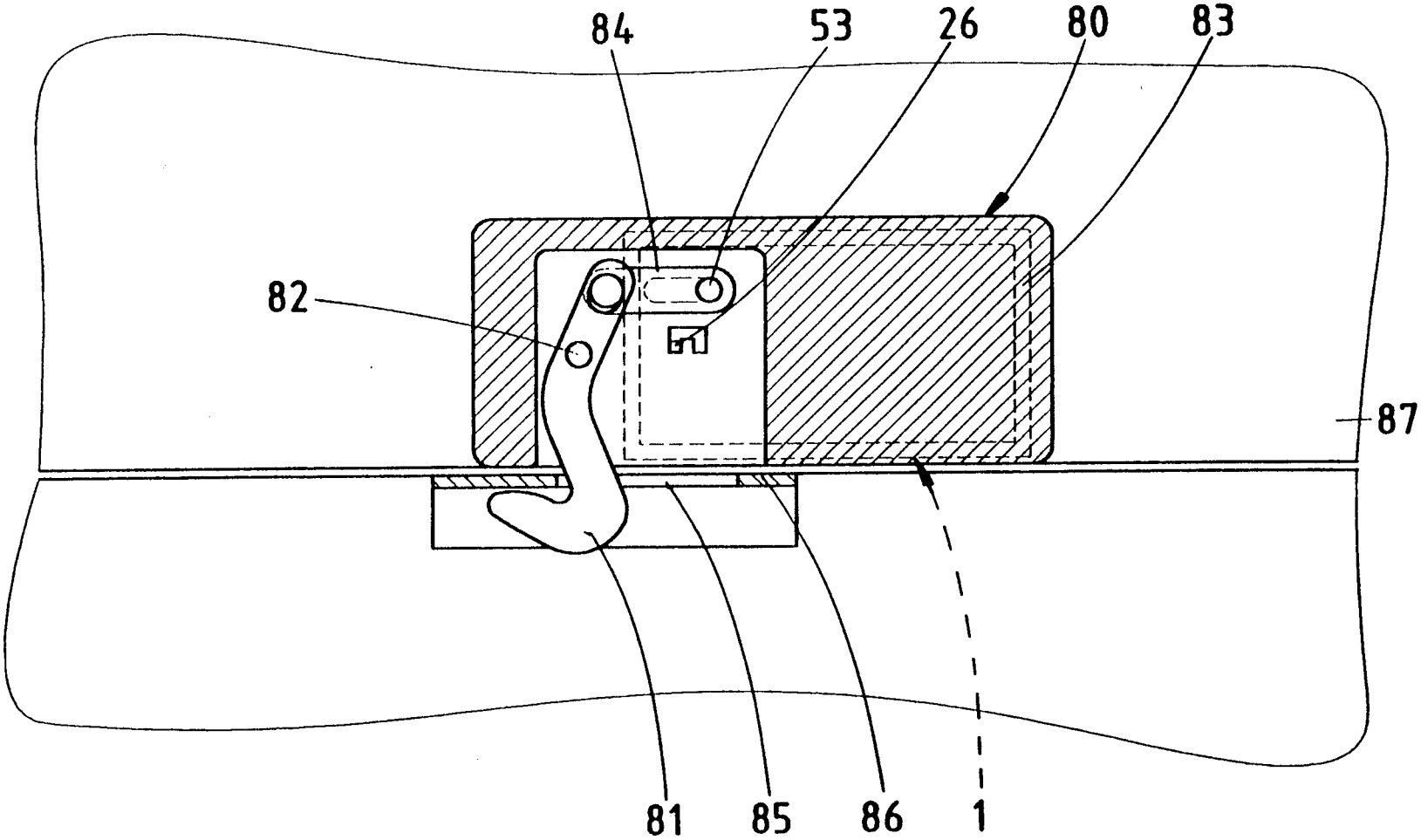
FIG. 31 is a section through the adapter housing which receives a link and the closure hook of a slide door, with a view of the inside of a vertically displaceable slide door of an article of furniture, in the closed position.
Figure 32:
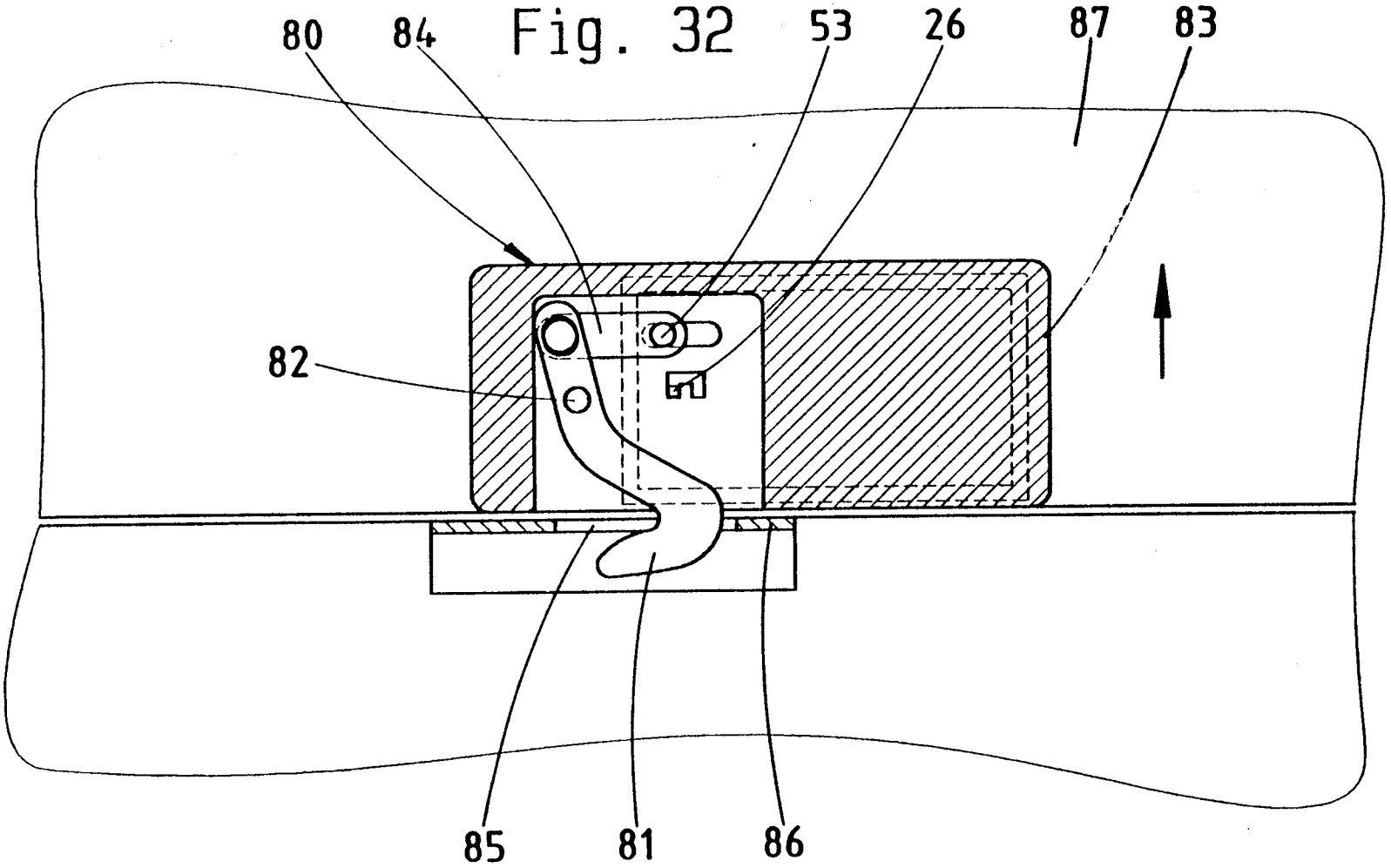
FIG. 32 is a view in accordance with FIG. 31 with the closure hook in the open position.
Figure 33:
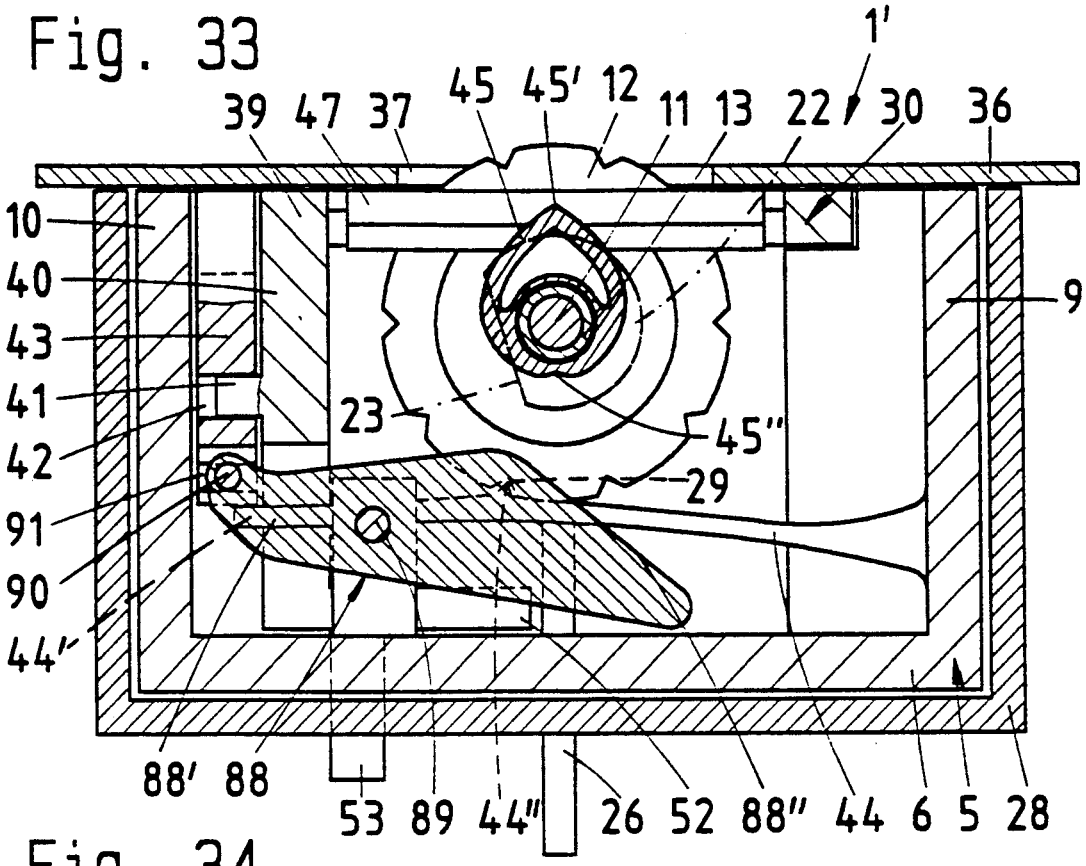
FIG. 33 is a cross section through a permutation lock of different development, the rotary displacement of the number disks being effected via a lever controlled by the slide, shown in the closed position of the permutation lock.
Figure 34:
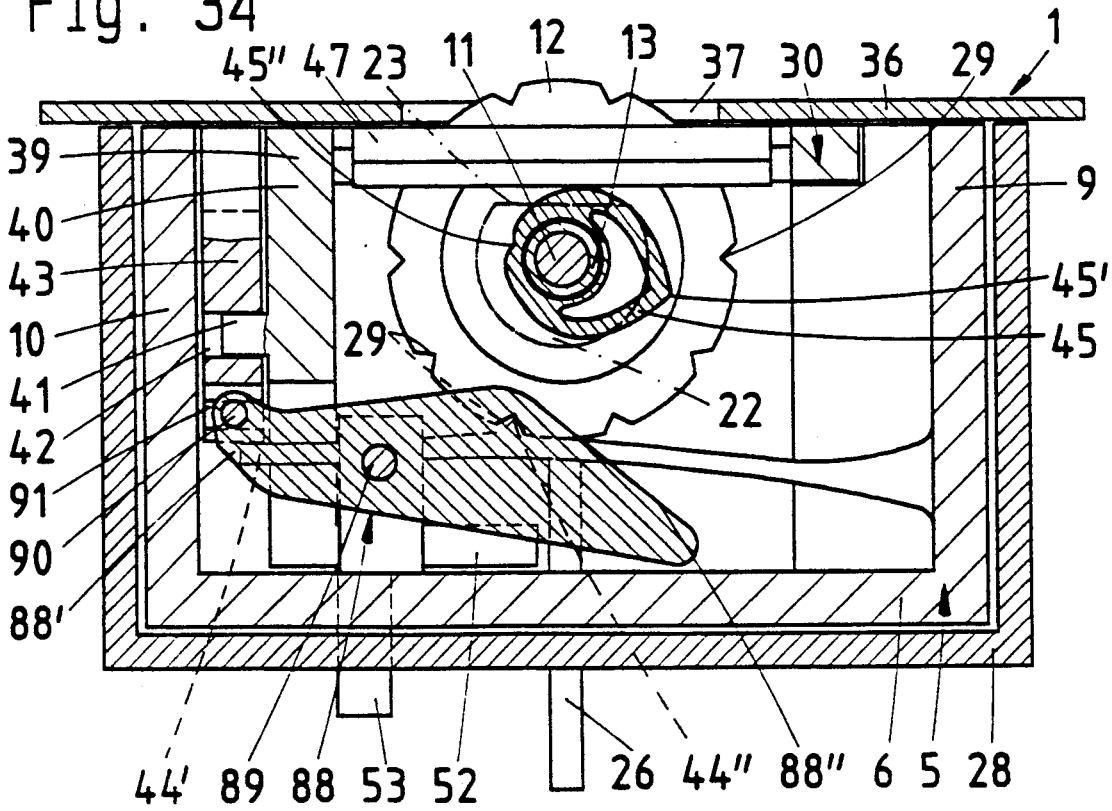
FIG. 34 is a showing similar to FIG. 33 with the combination of the number disks properly set.
Figure 35:
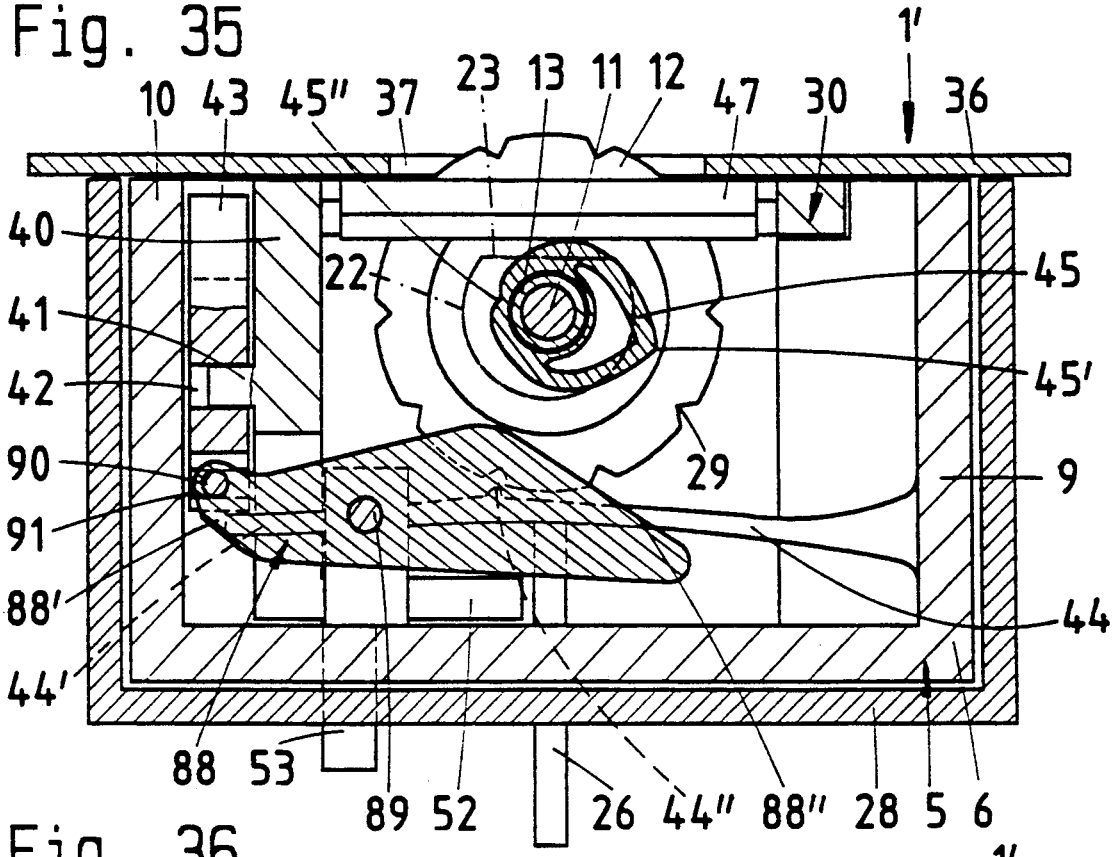
FIG. 35 is the subsequent showing upon displacement of the operating handle in open direction with simultaneous disengagement of the number disks.
Figure 36:
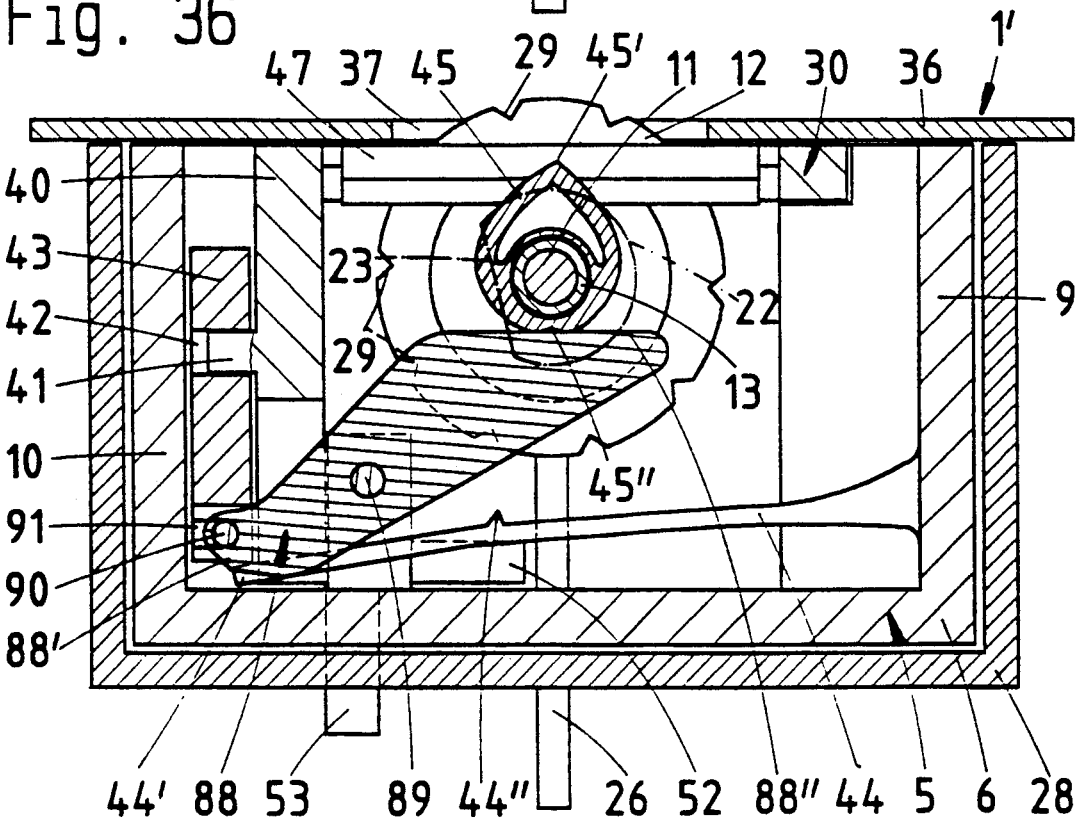
FIG. 36 is a section corresponding to the preceding showing in the open position of the permutation lock, the number disks being turned into the basic position, which differs from the combination.
Figure 37:
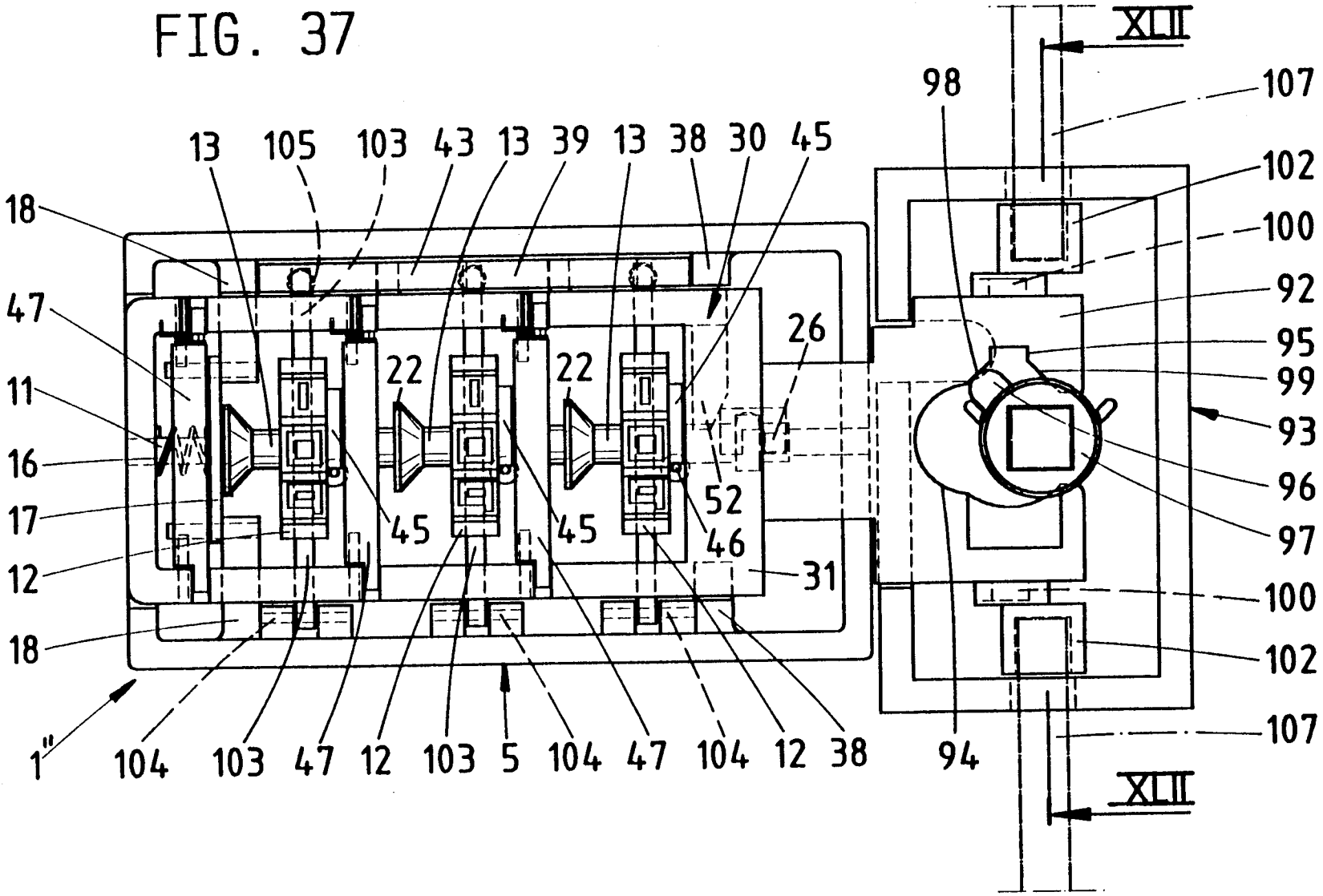
FIG. 37 is a top view of the permutation lock in accordance with another embodiment, the window slide forming the bolt tail of a rotary bar lock, shown in the closed position of the permutation lock.

FIGS. 31 and 32 show the cooperation of the permutation lock with a slide-door lock 80. The coupling pin 53 is now coupled with a link 84 which engages pivotally on a closure hook 81. For the mounting of the latter, a bolt 82 is provided on the housing 83 of the sliding door lock 80. In the closed position of the permutation lock, the closure hook 81 is so swung via the coupling pin 53 and link 84 that its free end has entered into an opening 85 in a closure plate 86 and its hook has gripped under the latter; see FIG. 31.

Opening again requires the setting of the correct combination by turning the number disks as well as the displacement of the operating handle in opening direction with simultaneous carrying along of the coupling pin 53 which, via the link 84, swings the closure hook 81 into the position shown in FIG. 32. The sliding door 87, which bears the permutation lock as well as the slide-door lock, can accordingly be opened in the direction indicated by the arrow.

FIGS. 33 to 36 show a modified embodiment of the permutation lock 1'. Identical parts bear the same reference numbers. In accordance with this version, there are no bar-shaped spring elements which rest continuously against the cardioid cam 45. Instead of the bar-shaped spring elements, levers 88 arranged in the same transverse plane as the cams are provided. Each of these levers 88 is developed as a double-armed lever. Each lever 88 is mounted on a pin 89 arranged on the lock-housing side and directed parallel to the rotation shaft 11. The end of the lever 88 facing the slide 43 is in pin/slot engagement with the slide 43. For this purpose, the shorter lever arm 88' is provided with a transverse pin 90 which engages into a transverse slot 91 in the lower region of the slide 43. The longer lever arm forms an obliquely rising flank 88'' which faces the cam 45 and which, in closed position (see, in particular, FIG. 33), is spaced from the cardioid cam 45. In this version also of the permutation lock 1', a spring tongue 44 is provided, the detent tooth 44'' of which engages into a detent cutout 29.

If the permutation lock is to be brought into open position, then the combination must be set by turning the number disks 12. The flats 23 of the blocking sleeves 33 then come into position parallel to the bars 47 of the window slide; see FIG. 34. By means of the operating handle 35, the window slide 30 can now be displaced in the direction of the open position, downward movement of the slide 43 being forcefully produced via the pin/slot engagement 41, 42. At the same time, the lever 88 is swung around its pin 89. An intermediate position can be noted from FIG. 35. Upon further downward displacement, the flank 88'' of the lever 88 then comes against the circumferential surface of the cardioid cam 45 and turns it, together with the number disk 12 as well as the blocking sleeve 13, into the position shown in FIG. 36. The tip 45' of the cardioid curve 45 is so associated with the number disk 12 that, in every detent position of the number disk at the time of the action on the cam 45, a lever arm is present on the cam with respect to the rotation shaft 11. The direction of force exerted by the lever 88 via its flank 88'' can therefore never pass through the cardioid tip 45' and turn shaft 11. In the open position therefore, the permutation is displaced so that the combination is not visible.

FIGS. 37 to 44 show a further embodiment of the permutation lock 1''. In this case also identical structural parts bear the same reference numbers. In this version, the window slide 30 is developed differently, it continuing in a bolt tail 92 of a rotary bar lock 93, which tail extends over the transverse side wall 8. A longitudinal slot-like recess 94 is developed in the bolt tail 92 from its free end. From the one narrow edge thereof, a closure engagement cutout 95 for the arm 96 of a turn nut 97 mounted in the rotary bar lock 93 extends. Oblique flanks 98, 99 of the recess 94 are adjacent the closure engagement opening 95. In the closed position (FIG. 37) the radius of the turn nut which passes through the arm 96 is perpendicular to the oblique flank 98; see FIG. 37.

The bolt tail 92 is provided on both of its outer longitudinal flanks with a coupling pin 100 which engages into a longitudinal slot 101 in each case of a turnable coupling piece 102. The latter receives in each case a turning bar 107 in form-locked fashion so that, upon displacement of the window slide 30 with control tail 92, a rotary displacement is produced at the turn bar 107.

The spring tongues 103 are developed differently in the case of the permutation lock 1''. They are now supported around a pin 104 which is arranged on the lock-housing side. They receive their spring actuation on their free end 103' by a compression spring 105 which rests against the bottom 6 of the lock housing 5. Approximately in the center region, the spring tongue 103 forms a detent tooth 106 pointing in the direction of the number disk 12 and cooperating, depending on the position of rotation of the number disk 12, with a corresponding detent cutout 29 thereof. In this embodiment also, upon displacement of the window slide 30 from its closed position shown in FIG. 40 into the open position shown in FIG. 41, the spring tongue 103 is swung by the slide 43, releasing the number disk 12. In this embodiment, the cardioid cam 45 is then acted on also by a bar-shaped spring element 46. The cardioid tip 45' is also so associated with the number disk 12 that the direction of the force does not extend through the cardioid tip, so that the cardioid cam 45 together with number disk 12 is always turned in one direction or the other until the cardioid base 45'' comes against the bar-shaped spring element 46 and terminates the rotary displacement.

Figure 38:
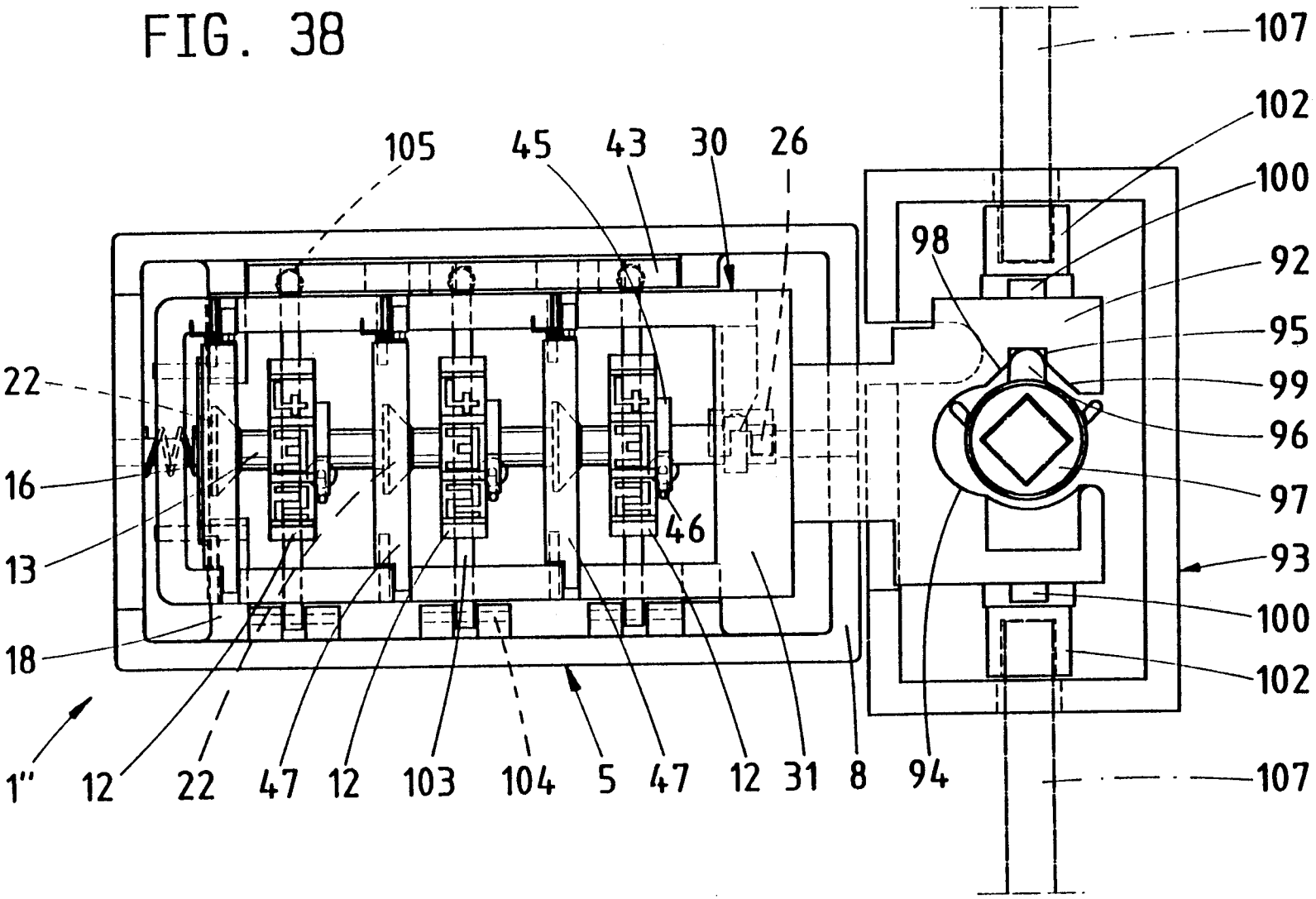
FIG. 38 is a showing similar to FIG. 37, but during the closing turning of the nut into the open position of the permutation lock.
Figure 39:
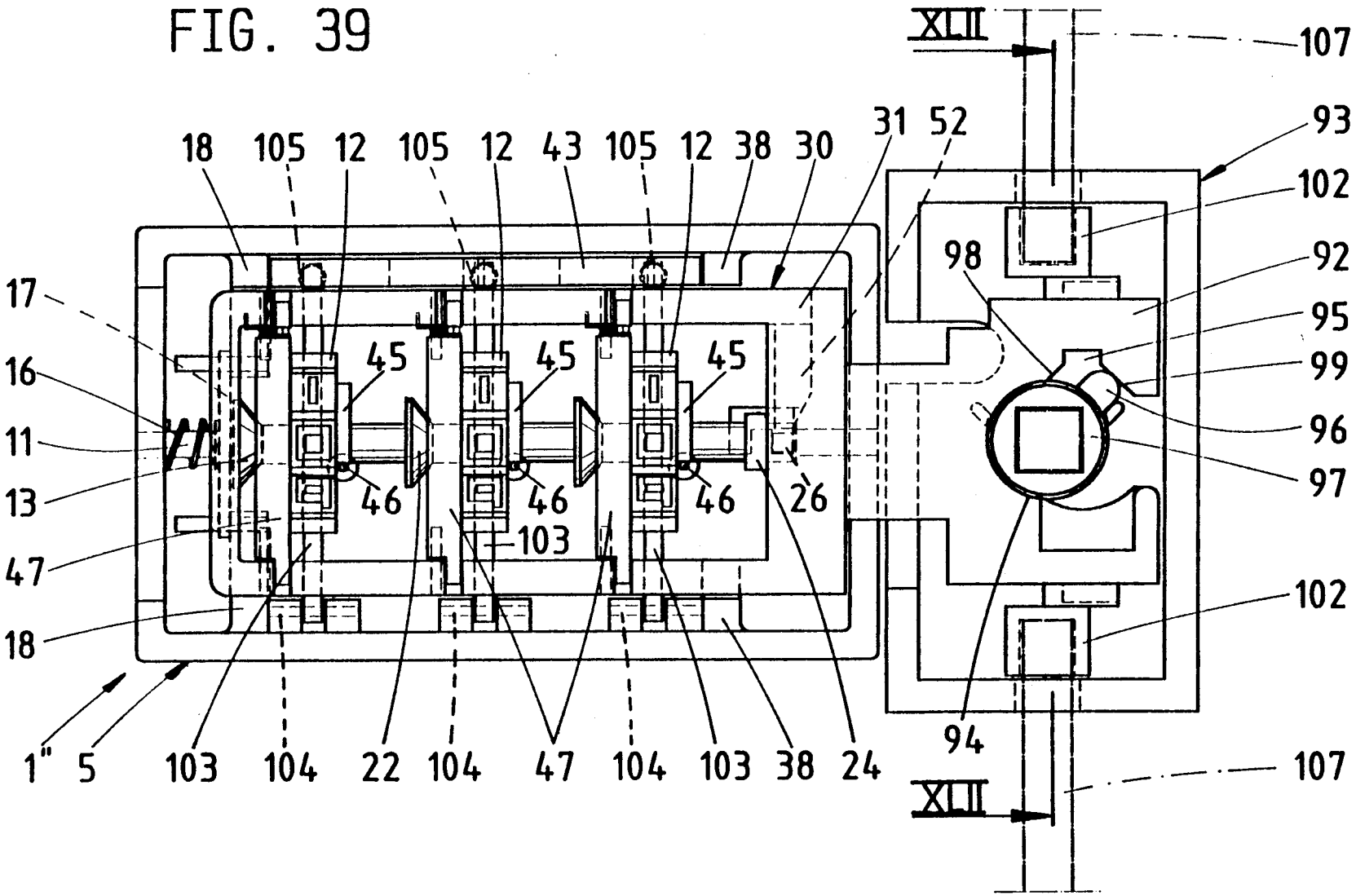
FIG. 39 shows the permutation lock in its open position.
Figure 40:
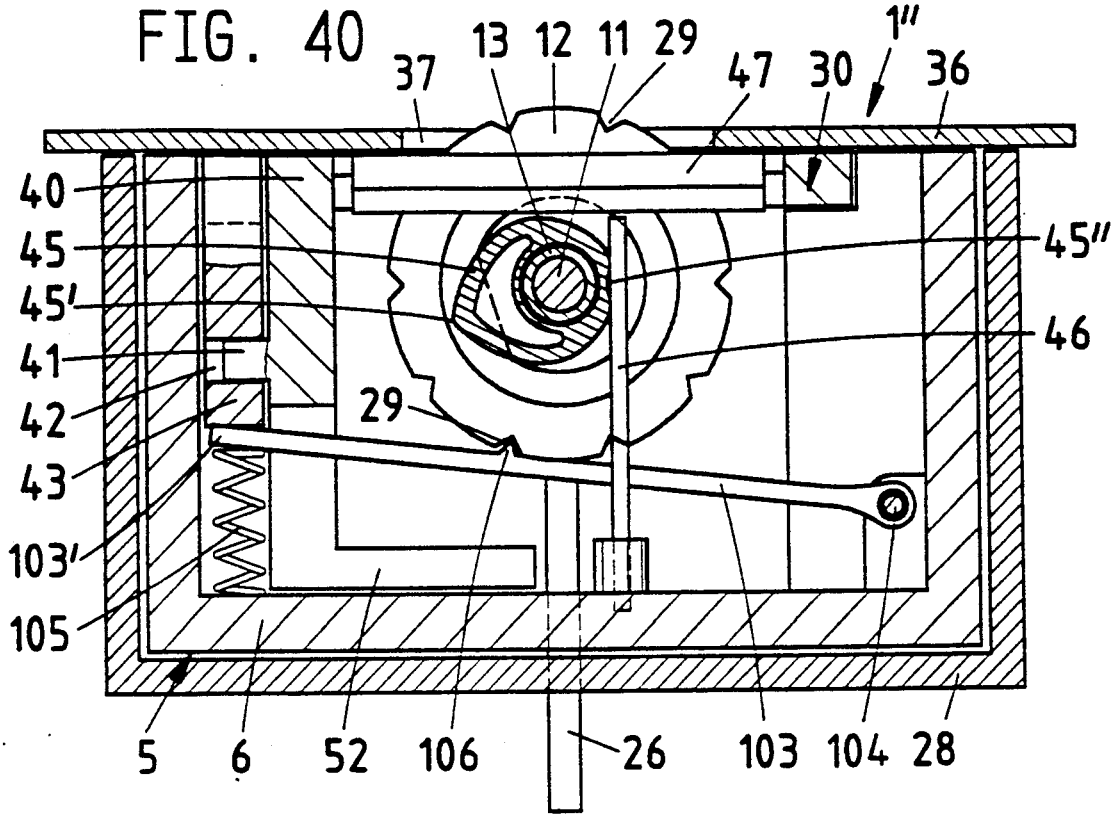
FIG. 40 is a cross section through the permutation lock in the closed position, with number disks set to the combination.
Figure 41:
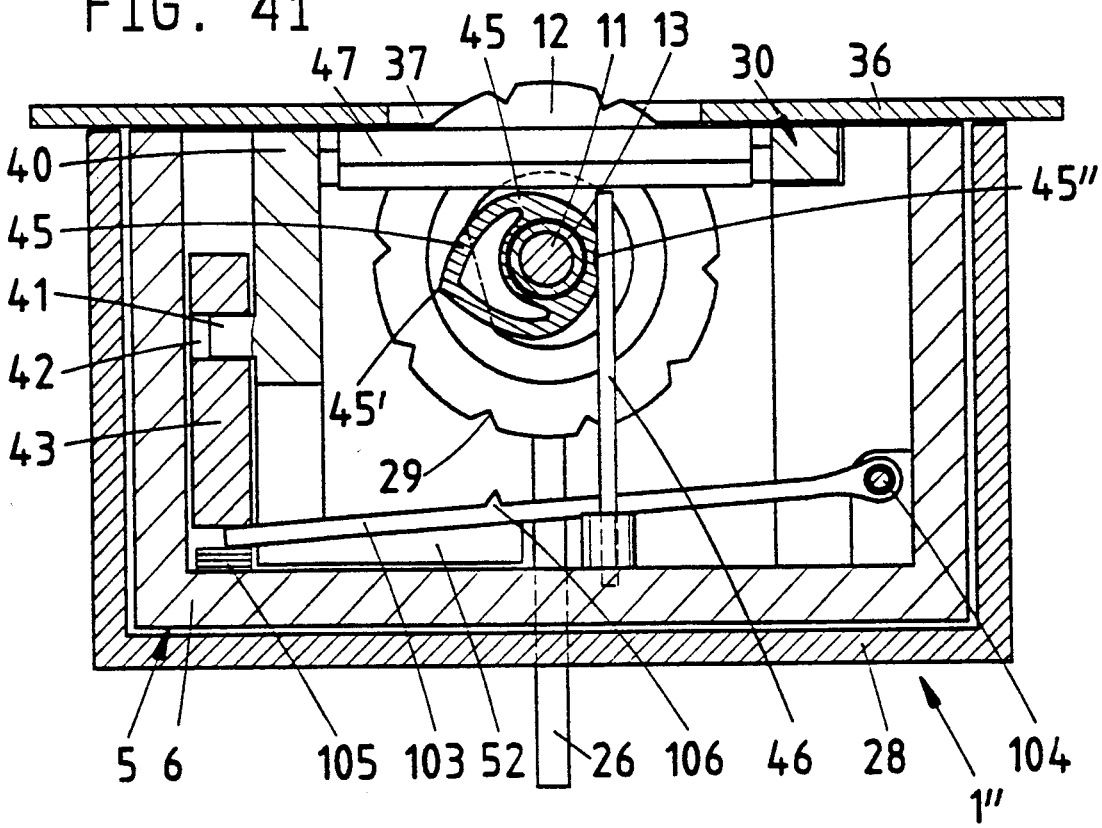
FIG. 41 is a showing corresponding to FIG. 40, but in open position.
Figure 42:
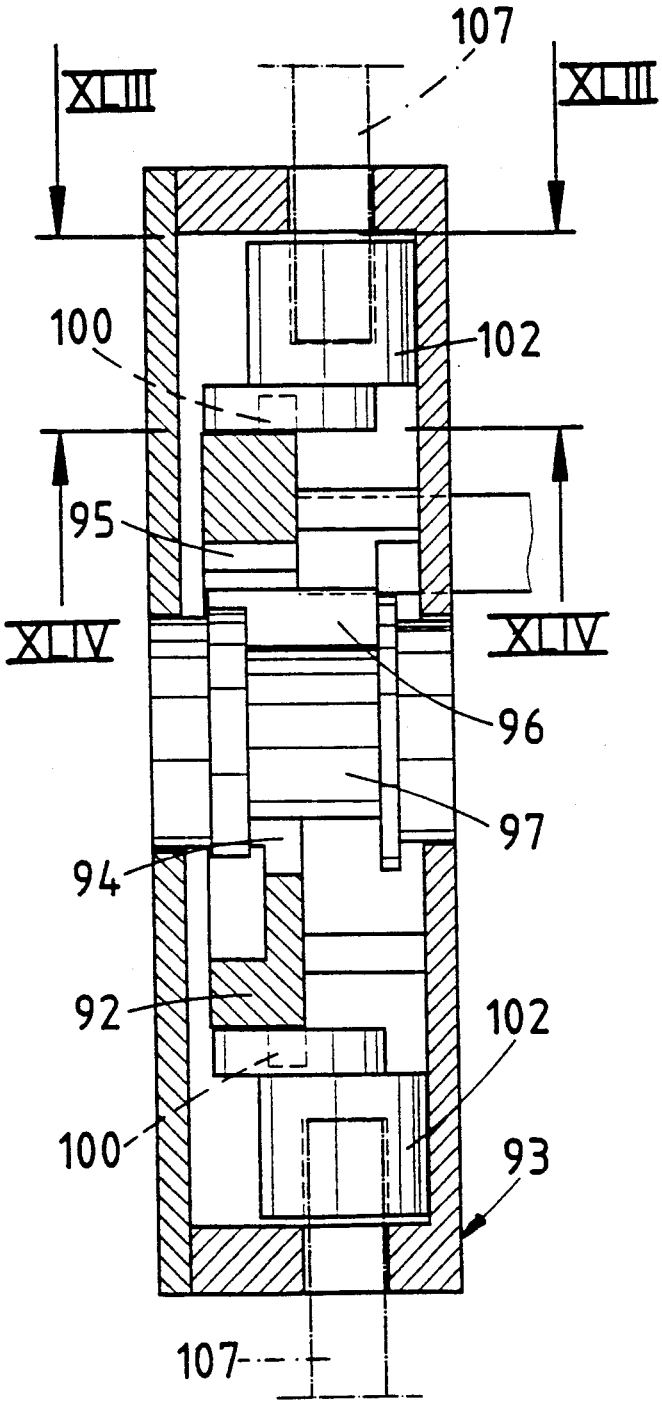
FIG. 42 is a section along the line XLII—XLII of FIG. 39.
Figure 43:
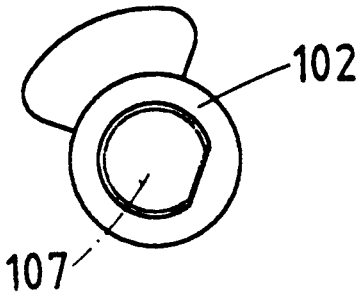
FIG. 43 is a section along the line XLIII—XLIII of FIG. 42.
Figure 44:
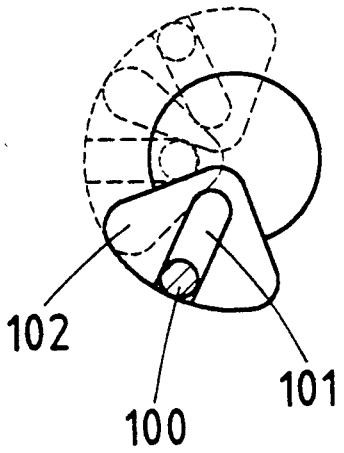
FIG. 44 is a section along the line XLIV—XLIV in FIG. 42.
Figure 45:
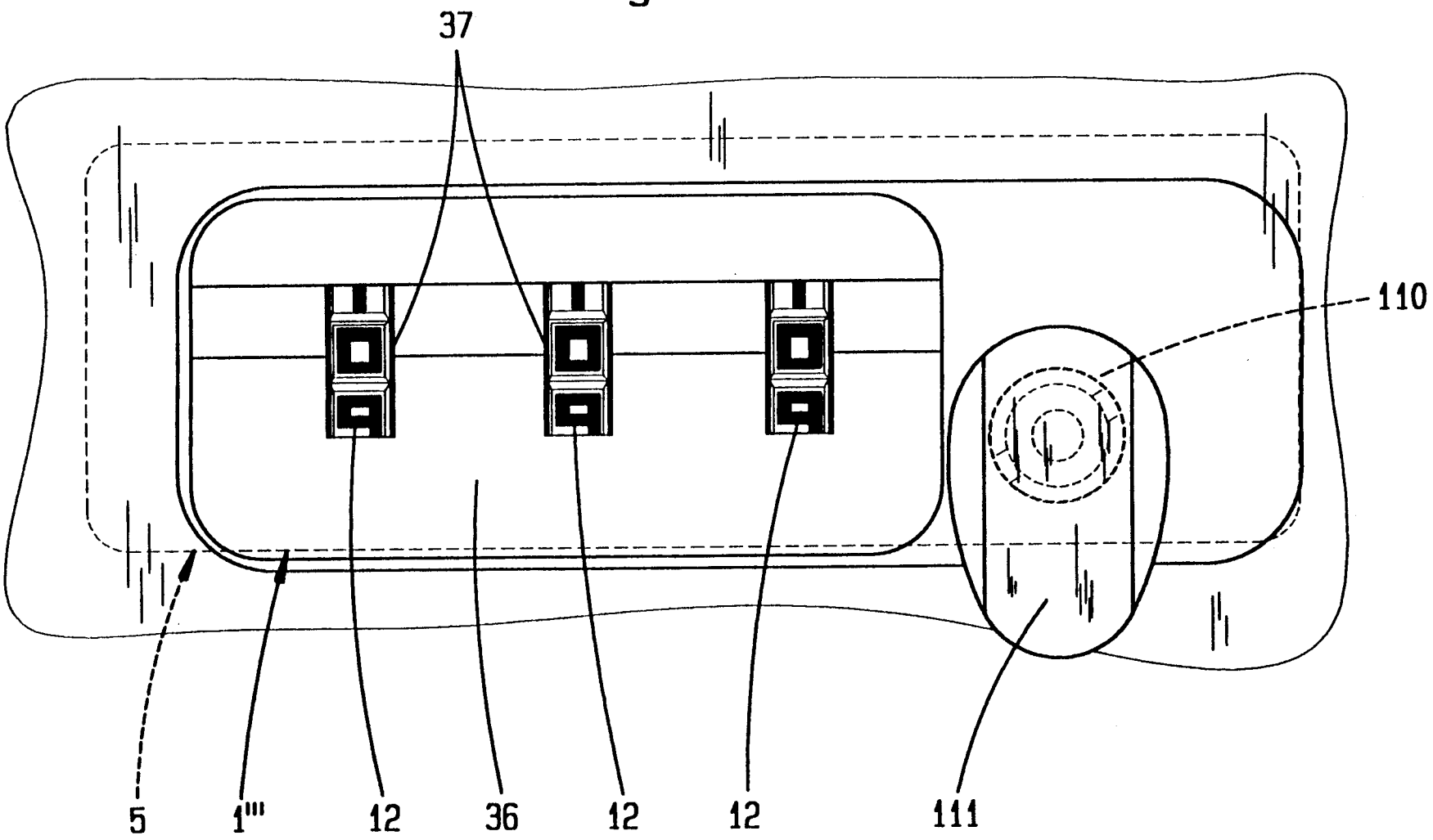
FIG. 45 is a front view of a differently shaped permutation lock which has an actuating turn handle.
Figure 46:
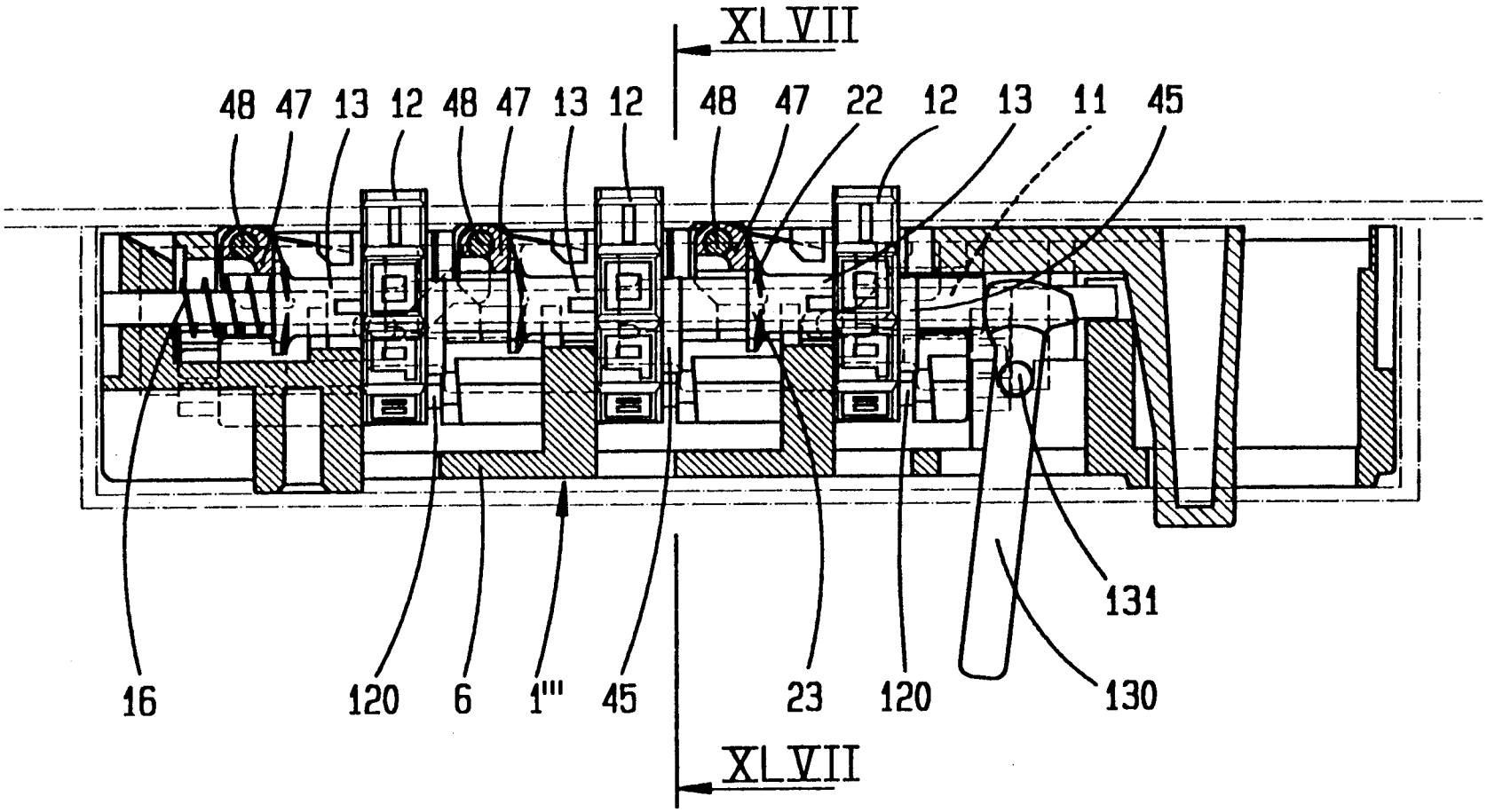
FIG. 46 is a longitudinal section through the permutation lock in its closed position.

FIG. 38 shows an intermediate position upon partially opening from the closed position. The rotary nut 97 which is coupled with a rotatable operating handle (not shown in FIG. 38) has then turned by about 45°. After a further 45° rotation, the open position shown in FIG. 39 is obtained. The radial passage through the arm 96 then extends perpendicular to the oblique flank 99. Rotation of the arm 96 produces a displacement of the bolt tail 92 along with window slide 30, and also imparts displacement to turn bars 107 via coupling pieces 102; see dot-dash showing in FIG. 44.

Figure 52:
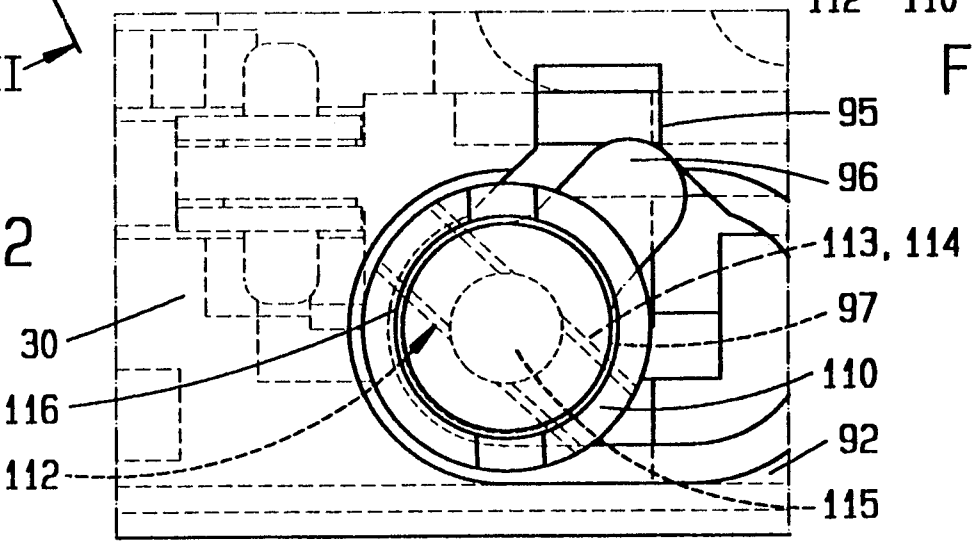
FIG. 52 is also a showing corresponding to FIG. 50, with the window slide shifted into the open position when the combination has been properly set.
Figure 50:
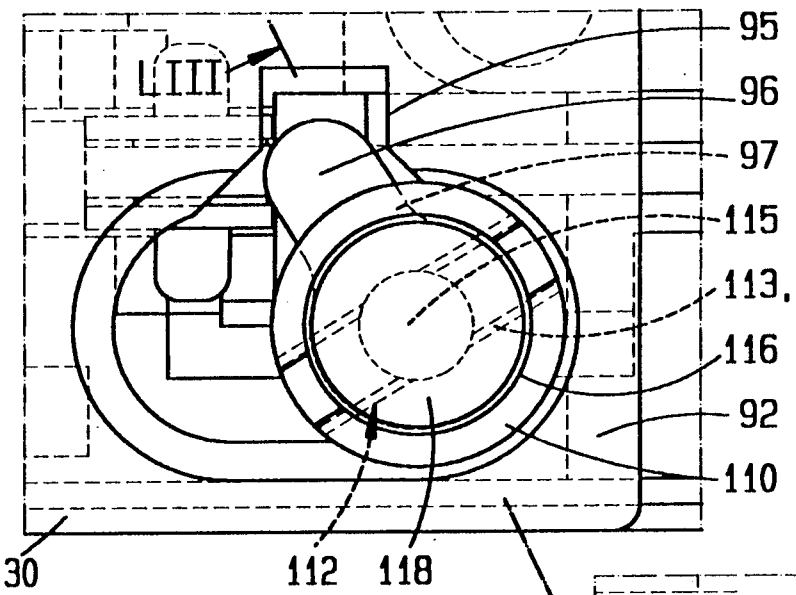
FIG. 50 is a partial top view of the actuation end of the permutation lock with the masking plate removed and the window slide in the closed position.

In the case of the permutation lock 1''', identical structural parts have also been provided with identical reference numbers. The window slide 30 also continues in a bolt tail 92 on which a rotary actuating handle 110 acts. The handle bears a knob 111. By means of the rotary actuating handle 110, a turn nut 97 can be brought from one end position into the other; see FIGS. 50 and 52. For this purpose, the turn nut 97 is also provided with an arm 96 which engages into a closure engagement opening 95 of the bolt tail 92 of the window slide 30.

A slip clutch 112 is interposed between the window slide 30, bolt tail 92 and rotary actuating handle 110. For this purpose, the turn nut 97 is coupled to the rotary actuating handle 110 in the manner that there is a rib/-groove engagement which is disengageable in opposition to the action of a spring. From the side of the rotary nut 97 facing the rotary actuating handle 110, there extends a rib 113 of trapezoidal cross section which engages in form-fitting manner into a diametral groove 114 in the opposite end of the rotary turning handle 110. The side flanks of the rib 113, as well as of the groove 114, extend in roof-like manner towards each other. The rotary nut 97 is mounted on a turn pin 115 anchored in the lock housing 5. Said pin at the same time passes through a hole 117 in the rotary actuating handle 110, the hole debouching in a pot-shaped depression 116. The turning pin 115 extends into the pot-shaped depression 116 and bears there a plate 118 firmly attached to it, spaced from the bottom of the depression. Between said plate and the base of the depression, a spring, developed as compression spring 119, is present on the turn pin 115, said spring maintaining the connected engagement between rib 113 and groove 114. Instead of a compression spring, a cup-spring assembly could also be used so as to be able to transmit even greater forces with a short spring path.

Figure 51:
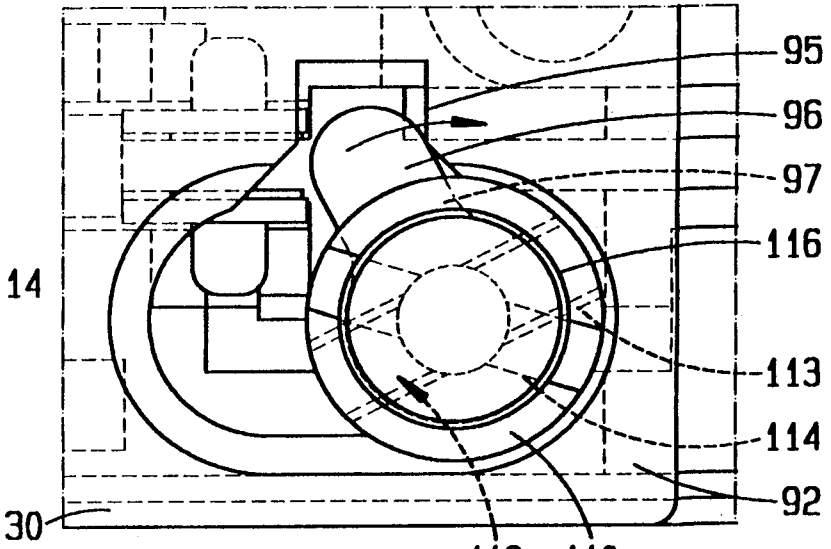
FIG. 51 is a showing in accordance with FIG. 50 with the slip clutch released.
Figure 54:
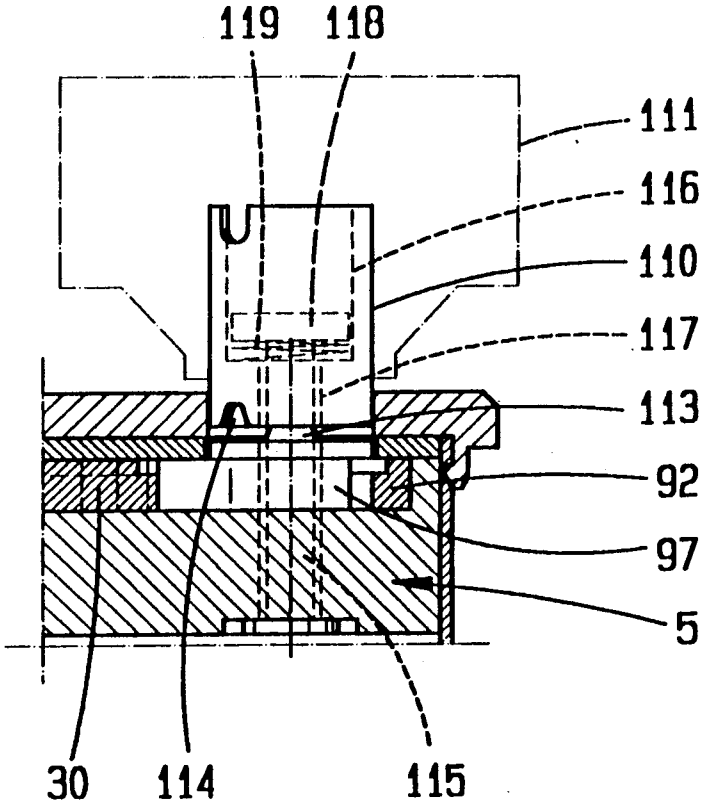
FIG. 54 is a showing corresponding to FIG. 53, but with the slip clutch released.
Figure 53:
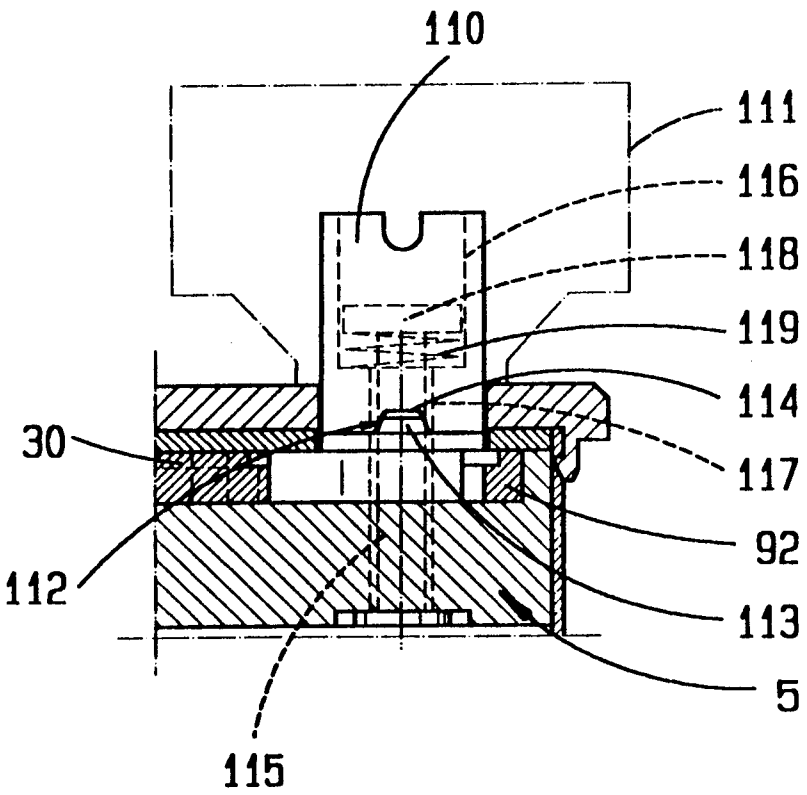
FIG. 53 is a section along the line LIII—LIII in FIG. 50.

The slip clutch 112 described above serves the task of overload protection. This is the case when the correct combination is not set. If the rotary actuating handle 110 is displaced by means of the knob 111, then the window slide 30 is carried along by a small amount by the rotary nut until its bars 47 strike the blocking sleeves 13. Upon further displacement of the rotary actuating handle 110, a superimposed axial displacement of the rotary actuating handle 110 in opposition to the force of the compression spring 119 occurs via the oblique flanks of the rib 113 and the groove 114; see FIGS. 51 and 54. The connection engagement or slip clutch 112 is thereby opened so that further displacement of the rotary actuating handle 110 does not exert any coercive forces on the lock.

Figure 47:
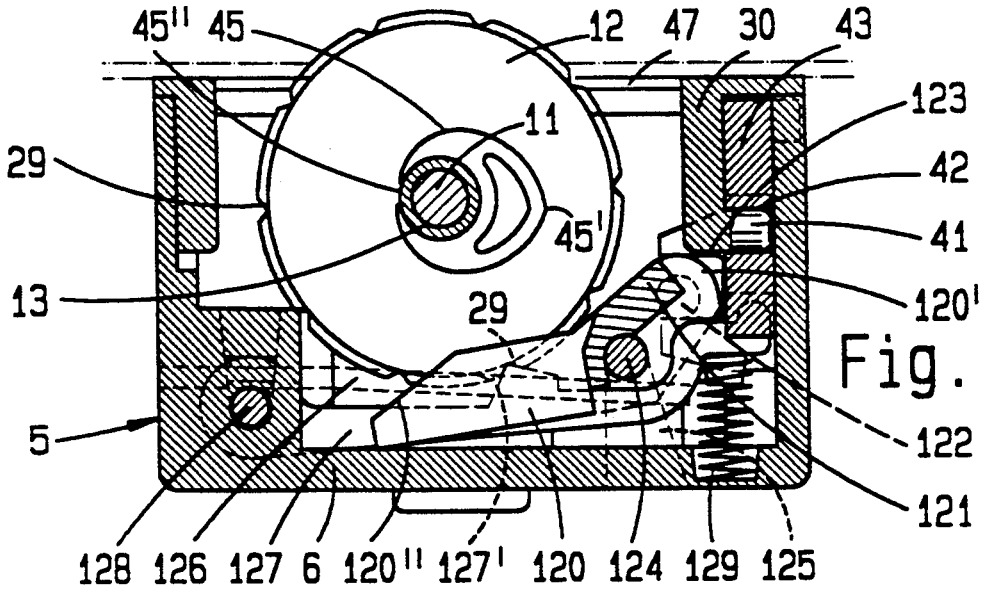
FIG. 47 is a section along the line XLVII—XLVII of FIG. 46.

Furthermore, in this version, the three levers 120 which are arranged one behind the other are connected together by a bridge 121. Transverse pins 122 which engage into transverse slots 123 of the slide 43 are provided on the shorter lever arm 120' of the outside levers 120. For the mounting of the levers 120, there is provided a shaft pin 124 which extends through them and rests in slots 125 of the lock housing 5 which are open towards the bottom 6. Two bar springs 126 which extend transversely in the lock housing 5 act on the ends of the shaft pin 124 and bring the latter in position against the bottom of the slot 125; see FIG. 47. The longer lever arm, which in the basic position rests against the bottom 6 of the lock housing, forms a flank 120'' which cooperates with the cam 45.

The spring tongues 127 associated with the number disks 12 are mounted on a housing-side pin 128. Each spring tongue 127 is provided with a detent tooth 127' which engages in spring-loaded manner into a detent cutout in the number disk 12. For the spring loading there are provided compression springs 129 which act on the free ends of the spring tongues 127. The free end thereof lies within the region of movement of the slide 43 and is controlled by the latter as in the embodiments mentioned above.

Figure 48:
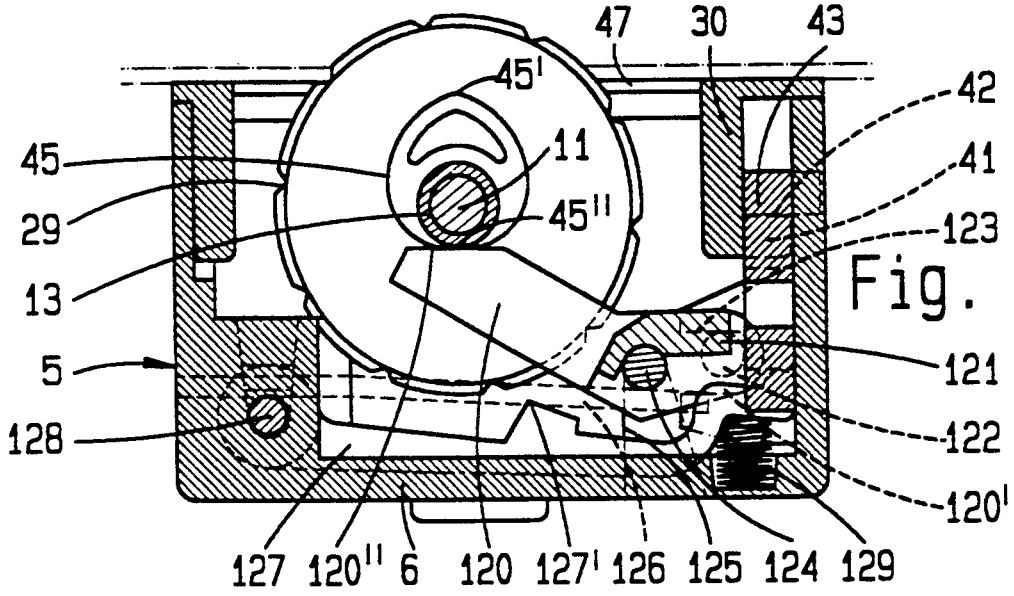
FIG. 48 is a showing corresponding to FIG. 47, showing however, the open position, with lever moved against the cam.
Figure 49:
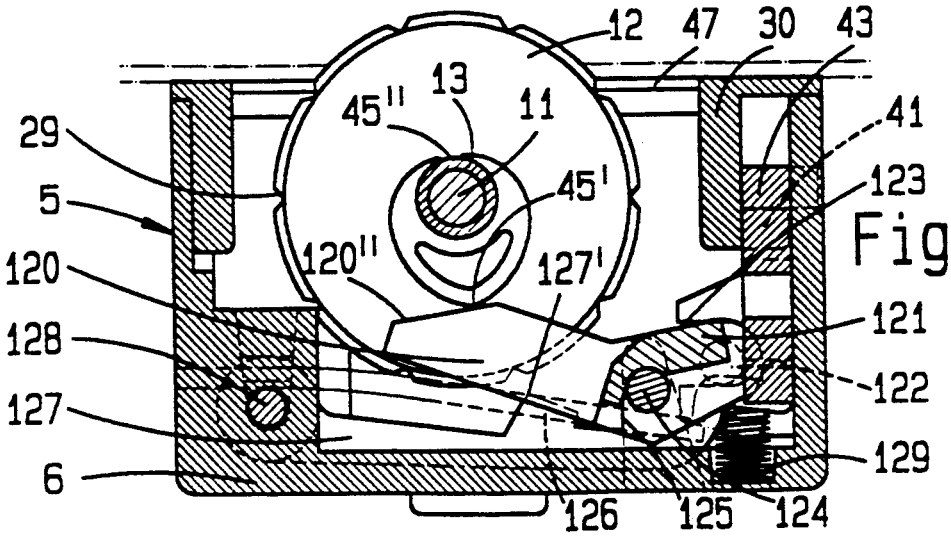
FIG. 49 is a consecutive showing after FIG. 48, the number disk being turned in the open position.

In this version also, the displacement of the window slide 30 requires the correct setting of the combination by means of the number disks 12. At the same time, the blocking sleeves 13 are so turned that they permit the passage of the bars 47 of the window slide 30. The window slide 30, via the pin/slot control, produces a downward displacement of the slide 43, the spring tongues 127 being brought out of engagement with the number disks 12. Furthermore, the levers 120 are swung by the slide 43, and their flanks 120'' act on the cam 45 and produce a forced rotation of the number disks 12 into a given basic position which differs from the combination; see FIG. 48. If the number disk 12 is unnecessarily turned in this position, then a position such as shown in FIG. 49 occurs. The oblique flank 120'' of the lever 120 is acted on by the cam 45. Due to the existing pin/slot engagement between transverse pin 122 and transverse slot 123, the shaft pin 124 moves against spring load in downward direction so that, in view of this evasive movement of the lever or levers 120, no destructive coercive forces occur. If the number disk 12 is released from the position shown in FIG. 49, then the spring load acting on the shaft pin 124 results in the position of the number disk 12 shown in FIG. 48.

Another modification of this permutation lock resides in the setting lever 130 being now developed as a swing lever. Near its end which acts on the rotation shaft 11, the setting lever 130 is mounted around transverse pins 131. A swinging of the setting lever 130 leads to a displacement of the blocking sleeves 13 against the action of the compression spring 16 acting on them. A displacement is effected when the combination is to be changed.

We claim:

1. A permutation lock, particularly for an enclosure comprising:

a plurality of number of disks which can be brought by rotation into a combination opening position;

a rotation axle, a plurality of spring tongues, a plurality of blocking sleeves, a window slide, an operating handle, and a plurality of cams with cam curves provided for corresponding ones of the number disks;

wherein said disks are arranged on said rotation axle and are engaged by respective ones of said spring tongues;

said blocking sleeves are operatively coupled to corresponding ones of said disks and have flats formed of flat surfaces, said window slide being located opposite the flat surfaces and having bars which are displaceable via movement in a direction parallel to said rotation axle, said handle serving to displace said slide only upon the occurrence of the combination opening position of the disks of the lock;

the cam curves of the respective number disks, as a result of action upon the cam curves by displacement of the operating handle then turn the number disks into a set of given basic positions, which differ from the positions of the respective disks in said combination opening position; and bars at the center of the window slide are developed as flap bridges and are spring-urged into blocking position, the center bars moving beyond the flat surfaces of said sleeves against spring load upon displacement of the window slide.

2. A permutation lock according to claim 1, wherein the action is obtained by means of a bar-shaped spring element.

3. A permutation lock according to claim 1, characterized by the fact that the action is obtained by a lever which swings as a result of the displacement of the operating handle and comes against a cam curve.

4. A permutation lock according to claim 1, further comprising a second slide which extends approximately parallel to the rotation axle and is movable by said window slide, and is displaceable upon movement of the operating handle in a direction transverse to a plane of movement of said window slide.

5. A permutation lock according to claim 1 characterized by the fact that the window slide is coupled to the rotary bar lock.

6. A permutation lock according to claim 5, characterized by the fact that a coupling pin of the window slide acts via a link on a control lever which effects bolt closure of the rotary bar lock.

7. A permutation lock according to claim 1, characterized by the fact that the window slide is coupled to a sliding-door lock (80).

8. A permutation lock according to claim 1, characterized by the fact that a coupling pin of the window slide acts via a link on a closure hook of a sliding door lock.

9. A permutation lock according to claim 1, characterized by the fact that the window slide forms a bolt tail which extends into a rotary bar lock and on which a rotary nut representing the operating handle acts.

10. A permutation lock according to claim 1, characterized by the fact that a journal pin of a lever is mounted so as to move away against spring load.

11. A permutation lock according to claim 1, characterized by the fact that a mounting is formed of slots directed towards a bottom of the lock.

12. A permutation lock according to claim 1, characterized by a spring-actuated slip clutch between the window slide and the operating handle.

13. A permutation lock according to claim 1, characterized by the fact that a turn nut is coupled with a rotary actuating handle in such a manner that a rib/-groove engagement which can be disengaged against spring action is present.

14. A permutation lock according to claim 1, characterized by the fact that a spring loading is obtained by means of a spring arranged in a pot-shaped depression in a rotary-actuating handle, which spring rests against a plate arranged on an end of a rotary shaft of the rotary-actuating handle.

15. A permutation lock according to claim 1, wherein the flap bridges have bevels allowing displacement of said slide in a closing direction.

16. A permutation lock according to claim 1, further comprising an additional slide, wherein the window slide is in coupling engagement with the additional slide for disengagement of said spring tongues from said disks, and the additional slide extends parallel to said rotation axis, and is movable transverse to the plane of movement of the window slide.

17. A permutation lock according to claim 1, wherein the cams are cardioid cams, the lock further comprising a lock case enclosing the number disks, and a bar-shaped spring element which is anchored in the bottom of the lock case, and which rests against the bottom of each cardioid cam, opposite a tip of the cardioid cam.

18. A permutation lock according to claim 1, further comprising a second slide operationally coupled to said window slide for movement transverse to the movement of said window slide by a pin/slot control with idle stroke located at the start of the movement of said second slide;

wherein said pin/slot control comprises a pin slot with a backlash portion located in said second slide, and a pin extending from said window slide for engagement with said slot.

19. A permutation lock according to claim 1, further comprising a combination resetting device having a setting lever extending from and slidably mounted to said rotational axle, the window slide having a projection for blocking a passage of the setting lever;

wherein said setting device is blocked in an open position of the operating handle by closing the passage of the setting lever by means of said projection of the window slide.

20. A permutation lock according to claim 1, wherein each of said blocking sleeves has a frustoconical cross-sectional taper on a flank of the sleeve, the flank facing a number disk, each sleeve having its flat offset from said axle and extending into said flank, the taper terminating at the flat.

21. A permutation lock according to claim 1, wherein an enclosure includes a central closure coupled to said window slide.

22. A permutation lock according to claim 21, wherein said central closure has a closure bar, the lock further comprising a linkage interconnecting said window slide with said closure bar, said linkage including a link and an angle lever pivoted to the link;

a coupling pin extending from said window slide to engage said link to act via said link on said angle lever; and a support pin disposed at an end of said angle lever for enabling said linkage to operate said central closure bar.

23. A permutation lock according to claim 18, further comprising a lever operative with one of said cams, wherein said second slide, upon undergoing a transverse movement, strikes said lever to urge said lever against said one cam.

24. A permutation lock comprising:

a plurality of number disks and a shaft for supporting said disks for rotation about an axis of said shaft;

a window slide having a window exposing said disks for viewing, and a handle extending from said window slide to permit manual translation of said window slide in a plane parallel to said shaft, said handle being operative to translate said window slide only upon the occurrence of a lock combination open position set by said number disks;

a plurality of cams operatively coupled to respective ones of said disks;

wherein, upon operation of said handle to open the lock, said window slide urges said cams to rotate said disks into a set of basic positions which differ from the positions of the respective disks in the open position of the lock combination;

said window slide has central bars for contacting said disks during a transverse movement of said window slide;

the number disks have blocking sleeves with flats associated with them; and the central bars of the window slide are formed as flap bridges which have control bevels lying in a direction of return travel of the window slide and are spring-loaded in a blocking direction for movement past the flats.

25. A permutation lock comprising:

a plurality of number disks and a shaft for supporting said disks for rotation about an axis of said shaft;

a window slide having a window exposing said disks for viewing, and a handle extending from said window slide to permit manual translation of said window slide in a plane parallel to said shaft, said handle being operative to translate said window slide only upon the occurrence of a lock combination open position set by said number disks;

a plurality of cams operatively coupled to respective ones of said disks, and a second slide;

a plurality of blocking sleeves operatively coupled to corresponding ones of said disks and having flats formed of flat surfaces;

wherein, upon operation of said handle to open the lock, said window slide urges said cams via said second slide to rotate said disks into a set of basic positions which differs from the positions of the respective disks in the open position of the lock combination;

a set of pins for slideably engaging said second slide with said window slide via an idle stroke during initial movement of said window slide for resetting positions of said disks, said window slide having central bars for engaging said disks during a transverse movement of said window slide; and said central bars are developed as flap bridges and are spring-urged into a blocking position, the central bars moving out beyond the flat surfaces of said sleeves against spring load upon displacement of the window slide.

26. A permutation lock according to claim 25, wherein movement of said second slide is obtained by a pin/slot control of said pins by provision of an idle stroke at the start of the movement of said second slide.

27. A permutation lock according to claim 25, wherein said blocking sleeves are disposed coaxially about said shaft and are located adjacent respective ones of said number disks, and each blocking sleeve develops a frustoconically descending cross-sectional tapering on its flank facing a number disk, said tapering of a flank of a blocking sleeve terminating at the region of a flat.

28. A permutation lock according to claim 25, further comprising a setting lever, a projection extending from said window slide, and a combination resetting device;

wherein said combination resetting device is blocked in the lock combination open position of the handle by a closure of a passage of the setting lever by the projection of the window slide.

29. A permutation lock according to claim 25, further comprising a central closure coupled to the window slide.

30. A permutation lock according to claim 25, further comprising a coupling pin connecting with the window slide, a central closure bar, an angle lever with a link connected thereto, the angle lever having a support pin for controlling the central closure bar; and wherein the coupling pin of the window slide acts via the link on the angle lever for controlling the central closure bar.

* * * * *